US009848969B2

(12) United States Patent
Yamane et al.

(10) Patent No.: US 9,848,969 B2
(45) Date of Patent: Dec. 26, 2017

(54) FERTILIZED EGG OR SPERM INJECTOR

(71) Applicants: NATIONAL FEDERATION OF AGRICULTURAL COOPERATIVE ASSOCIATIONS, Tokyo (JP); YAMANETECH, INC., Ina-shi, Nagano (JP); AIR WATER MACH INC., Matsumoto-shi, Nagano (JP)

(72) Inventors: Seiichi Yamane, Ina (JP); Masako Tugane, Hokuto (JP); Yutaka Takebuchi, Matsumoto (JP); Koji Ohmori, Matsumoto (JP)

(73) Assignees: NATIONAL FEDERATION OF AGRICULTURAL COOPERATIVE ASSOCIATIONS, Tokyo (JP); YAMANETECH, INC., Ina-Shi (JP); AIR WATER MACH INC., Matsumoto-Shi (JP)

( * ) Notice: Subject to any disclaimer, the term of this patent is extended or adjusted under 35 U.S.C. 154(b) by 267 days.

(21) Appl. No.: 14/403,051

(22) PCT Filed: May 17, 2013

(86) PCT No.: PCT/JP2013/063763
§ 371 (c)(1),
(2) Date: Nov. 21, 2014

(87) PCT Pub. No.: WO2013/176047
PCT Pub. Date: Nov. 28, 2013

(65) Prior Publication Data

US 2015/0112124 A1 Apr. 23, 2015

(30) Foreign Application Priority Data

May 22, 2012 (JP) ..... 2012-116699
Feb. 12, 2013 (JP) ..... 2013-024509

(51) Int. Cl.
*A61D 19/02* (2006.01)
*A61D 19/04* (2006.01)

(52) U.S. Cl.
CPC ..... *A61D 19/027* (2013.01); *A61D 19/04* (2013.01)

(58) Field of Classification Search
CPC .... A61D 19/02; A61D 19/027; A61D 19/024; A61D 19/04; A61B 17/43–17/435
See application file for complete search history.

(56) References Cited

U.S. PATENT DOCUMENTS 5,496,272 A 3/1996 Chung et al.
5,791,036 A 8/1998 Goodin et al.
(Continued)

FOREIGN PATENT DOCUMENTS

CA 2140926 A1 12/1994
EP 0643979 A1 3/1995
(Continued)

OTHER PUBLICATIONS

Kidder et al., "Nonsurgical collection and non surgical transfer of preimplantation embryos in the domestic rabbit (*Oryctolagus*) and domestic ferret (*Mustela putorius furo*)," Journal of Reproduction and Fertility, vol. 116, 1999, pp. 235-242.
(Continued)

*Primary Examiner* — Charles A Marmor, II
*Assistant Examiner* — Thaddeus Cox
(74) *Attorney, Agent, or Firm* — Birch, Stewart, Kolasch & Birch, LLP

(57) ABSTRACT

An injector for injecting a fertilized ovum(ova) or a sperm(s) for artificial insemination into a uterine body, by which an injection pipe can be introduced smoothly into a uterus, is disclosed. An injector for a fertilized ovum(ova) or a sperm (s) of the invention is characterized in that it comprises a
(Continued)

guide pipe for insertion into a uterine body, an injection pipe which is inserted into the guide pipe and has a length longer than the guide pipe, and a nozzle connected to a frontal end of the injection pipe, wherein the injection pipe comprises a flexible 1st pipe section constituting a frontal side of the injection pipe, and a 2nd pipe section being more rigid than the 1st pipe section and constituting a rear side of the injection pipe.

9 Claims, 13 Drawing Sheets

(56) References Cited

U.S. PATENT DOCUMENTS

| | | | | |
|---|---|---|---|---|
| 5,851,203 | A | 12/1998 | van Muiden | |
| 6,059,716 | A * | 5/2000 | Lee | A61D 19/027 600/35 |
| 6,454,756 | B1 * | 9/2002 | Sasaki | A61D 19/027 604/514 |
| 2003/0212307 | A1 * | 11/2003 | Hladky | A61D 19/027 600/33 |
| 2004/0199044 | A1 * | 10/2004 | Verberckmoes | A61D 19/027 600/35 |
| 2009/0326317 | A1 | 12/2009 | Huet et al. | |
| 2014/0155693 | A1 * | 6/2014 | Fabian | A61B 1/018 600/106 |

FOREIGN PATENT DOCUMENTS

| | | | |
|---|---|---|---|
| JP | 61-36935 | B2 | 8/1986 |
| JP | 62-042807 | U | 3/1987 |
| JP | 62-107819 | U | 7/1987 |
| JP | 64-4341 | Y2 | 2/1989 |
| JP | 2-42612 | U | 3/1990 |
| JP | 3-50892 | Y2 | 10/1991 |
| JP | 5-53617 | U | 7/1993 |
| JP | 6-154254 | A | 6/1994 |
| JP | 7-148264 | A | 6/1995 |
| JP | 8-501718 | A | 2/1996 |
| JP | 2505746 | Y2 | 7/1996 |
| JP | 8-280720 | A | 10/1996 |
| JP | 9-149938 | A | 6/1997 |
| JP | 2542719 | Y2 | 7/1997 |
| JP | 10-192409 | A | 7/1998 |
| JP | 2859364 | B2 | 2/1999 |
| JP | 2001-120581 | A | 5/2001 |
| JP | 3361778 | B2 | 10/2002 |
| JP | 2007-20795 | A | 2/2007 |
| JP | 2008-206881 | A | 9/2008 |
| JP | 2010-012247 | A | 1/2010 |
| WO | WO 94/28810 | A1 | 12/1994 |

OTHER PUBLICATIONS

Sasaki et al., Bulletin of the Shimane Prefectural Animal Husbandry, Experiment Station 37, 2004, pp. 6-10 (8 pages total) with the English translation.

International Search Report issued in PCT/JP2013/063763, dated Jun. 18, 2013.

English machine translation of JP-62-42807-U, published Mar. 14, 1987 (Japanese and English versions provided).

English machine translation of JP-9-149938-A, published Jun. 10, 1997 (Japanese and English versions provided).

* cited by examiner

FERTILIZED EGG OR SPERM INJECTOR

TECHNICAL FIELD

The present invention relates to an injector for injecting a fertilized ovum(ova) or a sperm(s) for artificial insemination to an animal such as a cow.

BACKGROUND ART

As an injector for injecting a fertilized ovum or a sperm for artificial insemination into the uterus of an animal such as a cow, an injector which comprises an injection pipe composed of a flexible tube inserted in a guide pipe and a nozzle connected at the frontal end of the injection pipe has been proposed (see, Patent Document 1). When injecting a fertilized ovum or a sperm using such an injector, a guide pipe in a state where an injection pipe is pulled inside the guide pipe is inserted through the vaginal opening into the uterine body, and then a frontal end of the injection pipe is pushed out from a frontal tip of the guide pipe by manipulating a protruding portion of a flexible tube constituting the injection pipe that protrudes from the rear side of the guide pipe so that the nozzle can reach a deep part of the uterine horn. Next, a sperm etc. is supplied from the rear side of the injection pipe to the nozzle to discharge the sperm etc. from the nozzle, and then the injector is pulled out through the vaginal opening.

PRIOR ART DOCUMENT(S)

Patent Document(S)

Patent Document 1: JP 3361778 B

SUMMARY OF THE INVENTION

Problems to be Solved by the Invention

In the case of the injector described in Patent Document 1, however, the entire injection pipe is composed of a flexible tube, and therefore buckling of the tube is apt to occur when the injection pipe is pushed out by manipulating a protruding portion of the injection pipe (tube) that protrudes out of the rear side of a guide pipe. As the consequence, the tube cannot be pushed out smoothly from the front tip of the guide pipe into a uterus. Therefore, the tube has to be pushed out many times, so that the handling is troublesome. Further, when pushing out the tube repeatedly, the nozzle comes in contact with an inner wall of a uterus many times, and as a result the inner wall of a uterus may be wounded.

In view of the above drawbacks, an object of the present invention is to provide an injector for a fertilized ovum(ova) or a sperm(s), which can introduce an injection pipe smoothly into a uterus.

Means for Solving the Problems

To solve the above-described problems, the present invention is an injector for injecting a fertilized ovum(ova) or a sperm(s) for artificial insemination into a uterine body, and characterized in that the injector comprises: a guide pipe for insertion into a uterine body; an injection pipe, which is inserted into the guide pipe, and has a length longer than the guide pipe; and a nozzle connected with a frontal end of the injection pipe, wherein the injection pipe comprises a flexible 1st pipe section constituting a frontal side of the injection pipe, and a 2nd pipe section being more rigid than the 1st pipe section and constituting a rear side of the injection pipe.

In using an injector for a fertilized ovum(ova) or a sperm(s) according to the present invention, a guide pipe is inserted through a vaginal opening into a uterine body in a state where an injection pipe is pulled in the guide pipe, and then a frontal side of the injection pipe is pushed out from the front tip of the guide pipe by manipulating a protruding portion of the injection pipe that protrudes out of the rear side of a guide pipe, so as to bring a nozzle to a deep part of the uterine body. Then a fertilized ovum(ova) or a sperm(s) is(are) supplied through the injection pipe to the nozzle to discharge the fertilized ovum(ova) or the sperm(s) from the nozzle, and thereafter the injector for a fertilized ovum(ova) or a sperm(s) is pulled out from the vaginal opening. In this case, a portion of the injection pipe protruding from the front tip of the guide pipe, when the injection pipe is pushed forward toward a frontal side, is a flexible 1st pipe section, and thus a nozzle placed at the front tip of the 1st pipe section can reach a deep part of the uterus. On the other hand, a portion of the injection pipe that protrudes out of the rear part of the guide pipe is a 2nd pipe section which is more rigid than the 1st pipe section. Therefore, when the injection pipe is pushed out from the front tip of the guide pipe by manipulating the 2nd pipe section, buckling of the 2nd pipe section will not occur. As a result, the frontal side of the injection pipe can be pushed out smoothly from the guide pipe into a uterus, and therefore the operability in injecting a fertilized ovum(ova) or a sperm(s) is superior.

In an embodiment of the present invention, it is preferred that a cylindrical connector be connected with the rear end of the 2nd pipe section. Since, with such a constitution, a fluid supplier for supplying a fluid for transporting a fertilized ovum(ova) or a sperm(s) to the nozzle can be connected with the rear side of the injection pipe through the cylindrical connector, the fluid supplier can be easily connected with the injection pipe. Further, since the cylindrical connector is connected with a highly rigid 2nd pipe section, hanging down of the fluid supplier, or the like, does not occur. Therefore, there is an advantage that the fluid supplier can be easily operated.

In an embodiment of the present invention, it is preferred that the cylindrical connector be an integrally molded item which is made of a resin or a rubber and comprises a plurality of step parts formed on an inner circumferential surface thereof, said step parts each enlarging the inner diameter size at both sides of the central portion in an axis line direction. Since, with such a constitution, the inner diameter size of the cylindrical connector is enlarged at both end sides in an axis line direction, the 2nd pipe section of the injection pipe and the fluid supplier can be easily connected with the two sides of the cylindrical connector, respectively. Since the cylindrical connector is made of a resin or a rubber, a mold can be removed from a cylindrical connector by a forced demolding method utilizing the elasticity of a resin material or a rubber material when molding a cylindrical connector. Consequently, a cylindrical connector can be produced as an integrally molded item with a low-cost mold, allowing cost reduction of a cylindrical connector.

In an embodiment of the present invention, it is preferred that an outer peripheral surface of the cylindrical connector have a shape for preventing rotation of the cylindrical connector around the axis line. Since, with such a constitution, the cylindrical connector does no roll, even when the cylindrical connector is placed alone on a work table, etc., it is convenient to handle.

In an embodiment of the present invention, it is preferred that the injection pipe comprise: a flexible tube having a length longer than the guide pipe, and being inserted into the guide pipe; and a rigid sleeve which is arranged so that the outside of a rear part of the tube is covered with the sleeve, leaving a frontal part of the tube in an exposed state, and whose rigidity is higher than the tube, and wherein the 1st pipe section is constituted by a portion of the tube that protrudes from the rigid sleeve at the frontal side, and wherein the 2nd pipe section is constituted by the rigid sleeve and a portion of the tube positioned inside the rigid sleeve. Since, with such a constitution, a flexible tube is present along the total length of the injection pipe, a fertilized ovum(ova) or a sperm(s) pass(es) inside the flexible tube. Therefore, insofar as a clean tube is used, a fertilized ovum(ova) or a sperm(s) is(are) free from contamination. Further, since a flexible tube functions as a heat insulating material, even when an injection operation is carried out in a low temperature atmosphere e.g. in wintertime, there is little risk of impairment of the activity of a fertilized ovum(ova) or a sperm(s) due to overcooling.

In this case it is preferred that at least a frontal end of the rigid sleeve be fixed to the tube by adhesion. With such a constitution, a portion of the tube positioned inside the rigid sleeve moves surely in one together with the rigid sleeve when the rigid sleeve is manipulated. Further, the injection pipe is flexible only at the 1st pipe section. Therefore, when the rear side of the 2nd pipe section of the injection pipe (rigid sleeve) is manipulated so as to be pushed forward, the nozzle follows the manipulation accurately and moves deeper into a uterus.

In an embodiment of the present invention, a form in which the injection pipe comprises a flexible tube and a rigid pipe, the rigid pipe being connected to a rear side of the tube and having a rigidity higher than the tube, wherein the 1st pipe section is constituted by the tube and the 2nd pipe section is constituted by the rigid pipe, may be adopted. Since, with such a constitution, the flexible tube can be shortened, costs for components can be reduced.

In an embodiment of the present invention, a form in which the injection pipe comprises: a flexible 1st tube positioned on a frontal side of the injection pipe; a flexible 2nd tube positioned on a rear side of the 1st tube; and a rigid sleeve which is arranged so that the outside of the 2nd tube is covered with the sleeve and whose rigidity is higher than the 2nd tube and the 1st tube, wherein the 1st pipe section is constituted by the 1st tube and the 2nd pipe section is constituted by the 2nd tube and the rigid sleeve, may be adopted.

In this case, it is preferred that the 1st tube and the 2nd tube be apart from each other in an extending direction of the injection pipe, and that an enlarged diameter space having an inner diameter larger than the inner diameter sizes of the 1st and the 2nd tubes be formed between the 1st tube and the 2nd tubes. With such a constitution, in a preparation stage a fertilized ovum(ova) or a sperm(s) can be supplied into the injection pipe and temporarily retained in the enlarged diameter space.

In an embodiment of the present invention, it is preferred that the injection pipe comprise a reinforcing layer with which a boundary part between the 1st pipe section and the 2nd pipe section is covered. In such a constitution, the rigidity of the injection pipe increases from the frontal side to the rear side. Therefore, when the injection pipe is pushed out from the guide pipe, buckling of the injection pipe is unlikely to occur, and the frontal end (nozzle) of the injection pipe can be easily penetrated into a deep part of a uterine body.

In an embodiment of the present invention, it is preferred that the nozzle comprise: a stopping part having an outer diameter size larger than the inner diameter size of the guide pipe; and a connecting cylindrical part connected with the frontal end of the injection pipe on the rear side from the stopping part. With such a constitution, when the injection pipe is pulled into the guide pipe, the nozzle is never pulled into the guide pipe.

In an embodiment of the present invention, it is preferred that the stopping part be formed by a portion of the nozzle, the outer diameter size of which increases continuously from a rear side toward a frontal side, and that a portion ranging from the connection part between the injection pipe and the connecting cylindrical part to the stopping part extend without any step part that has an outer diameter size larger than the outer diameter size of the 1st pipe section and faces toward the injection pipe. With such a constitution, since the stopping part is formed by a portion whose outer diameter increases continuously from a rear side toward a frontal side, the uterus inner wall is never wounded by a step in the stopping part when an injector for a fertilized ovum(ova) or a sperm(s) is pulled out from the vaginal opening. Further, since a fertilized ovum(ova) is(are) not caught and scraped out by a step in the stopping part when an injector for a fertilized ovum(ova) or a sperm(s) is pulled out from the vaginal opening, the conception rate can be improved. Furthermore, there is no step part having an outer diameter size larger than the outer diameter size of the 1st pipe section in a portion ranging from the connection part between the injection pipe and the connecting cylindrical part to the stopping part. Therefore, the uterus inner wall is never wounded by a step in the connection part between the injection pipe and the nozzle when an injector for a fertilized ovum(ova) or a sperm(s) is pulled out from the vaginal opening. Furthermore, since a fertilized ovum(ova) is(are) not caught and scraped out by a step in the connection part between the injection pipe and the nozzle when an injector for a fertilized ovum(ova) or a sperm(s) is pulled out from the vaginal opening, the conception rate can be improved.

In an embodiment of the present invention, a constitution in which at the connection part between the injection pipe and the connecting cylindrical part the frontal end of the injection pipe is inserted into the connecting cylindrical part, and an outer peripheral surface of the connecting cylindrical part is formed into a tapered surface whose diameter continuously decreases toward the rear side, may be adopted. With such a constitution, a structure in which no step is formed at a connection part between the injection pipe and the nozzle, or a structure in which a step at a connection part between the injection pipe and the nozzle is limited in size can be materialized.

In an embodiment of the present invention, it is preferred that the outer diameter size of a rear edge of the connecting cylindrical part be reduced by the tapered surface to the outer diameter size of the 1st pipe section or less. With such a constitution, even in the case of a structure in which the frontal end of the injection pipe is inserted into the connecting cylindrical part, a step part whose outer diameter size is larger than the outer diameter size of the injection pipe is not formed at the connection part.

In an embodiment of the present invention, it is preferred that at the frontal end of the injection pipe, a reinforcing pipe for connection be inserted into the injection pipe, and that the frontal end of the injection pipe be inserted into an annular space formed between the reinforcing pipe for connection and the connecting cylindrical part. With such a constitution, a situation where the injection pipe is squashed will not occur even when the injection pipe is pushed into the connecting cylindrical part of the nozzle. Further, since the injection pipe is put in an annular space between the connecting cylindrical part of the nozzle and the reinforcing pipe for connection, the connection strength between the nozzle and the injection pipe is high. Therefore, falling off of the nozzle from the injection pipe can be securely prevented.

In an embodiment of the present invention, it is preferred that a frontal end of the reinforcing pipe for connection protrude out of the frontal end of the injection pipe, and that a reinforcing pipe holding section for holding the frontal end of the reinforcing pipe for connection be provided inside the nozzle. With such a constitution, an attitude of the reinforcing pipe for connection can be maintained properly, and therefore an annular space can be formed properly between the connecting cylindrical part of the nozzle and the reinforcing pipe for connection.

In an embodiment of the present invention, a constitution in which the connecting cylindrical part is inserted into the injection pipe at a connection part between the injection pipe and the connecting cylindrical part may be adopted. With such a constitution, the nozzle can be connected with the injection pipe without forming a step part that has an outer diameter size larger than the outer diameter size of the injection pipe and faces toward the injection pipe.

In this case it is preferred that at least either one of a protruding part(s) that bite(s) into an inner surface of the injection pipe and a recessed part(s) that is(are) bitten into by the injection pipe be formed on the outer surface of the connecting cylindrical part. With such a constitution, since the connection strength between the nozzle and the injection pipe is high, falling off of the nozzle from the injection pipe can be securely prevented.

In an embodiment of the present invention, it is preferred that the injection pipe be longitudinally separable by a joint provided at a given position in the longitudinal injection pipe. With such a constitution, it is possible to divide the injection pipe, use a part thereof repeatedly after washing, and to use the other part only once and then discard it.

In an embodiment of the present invention, it is preferred that a click mechanism for changing a load when the injection pipe is advanced or retreated in the guide pipe be provided between the injection pipe and the guide pipe. With such a constitution, how long the injection pipe extrudes can be grasped by a click feeling when the injection pipe is pushed out from the guide pipe. Similarly, how long the injection pipe is pulled in can be grasped by a click feeling when the injection pipe is pulled into the guide pipe. Further, unintended movement of the injection pipe in the guide pipe can be prevented by a load generated by the click mechanism.

Effects of the Invention

In the injector for a fertilized ovum(ova) or a sperm(s) according to the present invention, a part of the injection pipe protruding from the front tip of the guide pipe is a flexible 1st pipe section when the injection pipe is pushed forward toward the frontal side, and therefore a nozzle placed at the front tip of the 1st pipe section can reach a deep part of the uterus. On the other hand, a part of the injection pipe protruding out of the rear part of the guide pipe is a 2nd pipe section more rigid than the 1st pipe section. Therefore, when the injection pipe is pushed out from the front tip of the guide pipe by manipulating the 2nd pipe section, buckling of the 2nd pipe section will not occur. Thus, the frontal side of the injection pipe can be pushed out smoothly from the guide pipe into the uterus, and therefore the operability in injecting a fertilized ovum(ova) or a sperm(s) is superior.

MODE FOR CARRYING OUT THE INVENTION

Preferred embodiments of the present invention will be specifically described below by way of drawings.

[Embodiment 1]

(Overall Construction)

Figure 1:
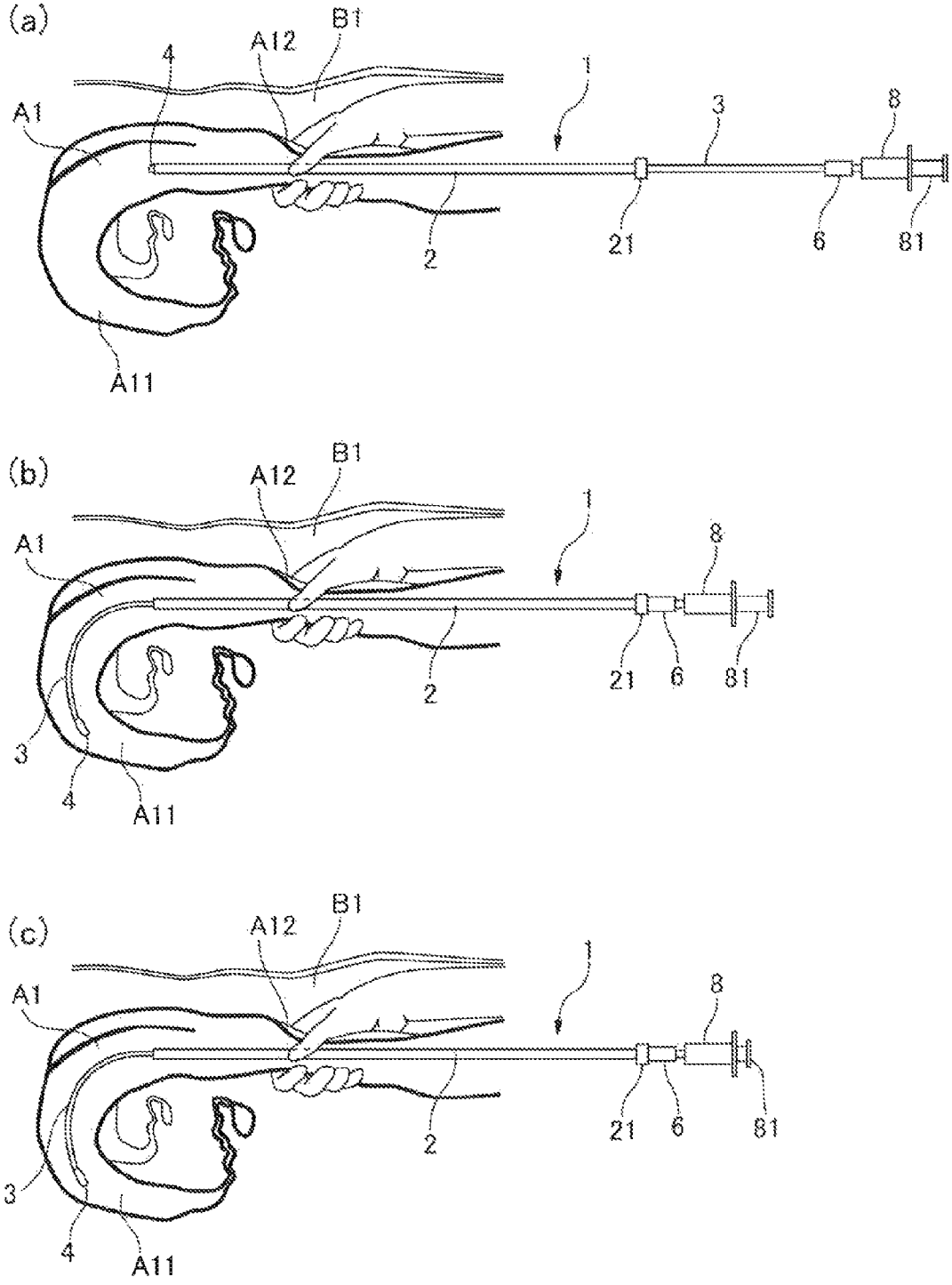
FIG. 1 is diagrams of an injector (injector for a fertilized ovum(ova) or a sperm(s)) according to Embodiment 1 of the present invention.
Figure 2:
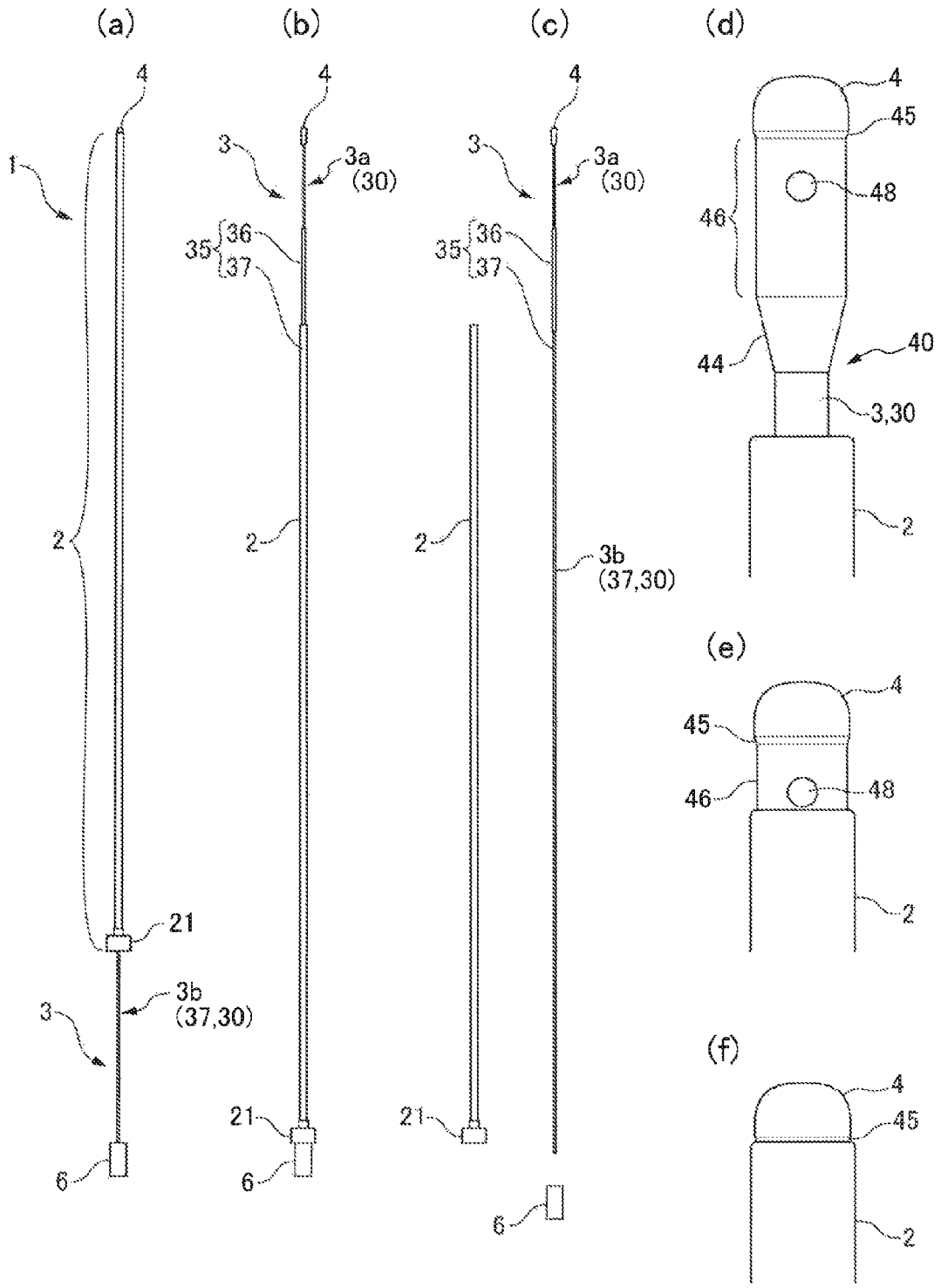
FIG. 2 is diagrams of major components of an injector according to Embodiment 1 of the present invention.

FIG. 1 is diagrams of an injector (injector for a fertilized ovum(ova) or a sperm(s)) according to Embodiment 1 of the present invention, and FIGS. 1(*a*), (*b*), and (*c*) show a situation where an injector is inserted into the inside of the uterine body of a cow, a situation where a nozzle is advanced to a deep part of the uterine horn, and a situation where a fertilized ovum is injected to a deep part of the uterine horn, respectively. FIG. 2 is diagrams of major components of an injector according to Embodiment 1 of the present invention, and FIGS. 2(*a*), (*b*), (*c*), (*d*), (*e*), and (*f*) show, respectively, a situation where an injection pipe is pulled in a guide pipe, a situation where the frontal side of an injection pipe is pushed out from a guide pipe, a situation where an injection pipe is pulled out from a guide pipe, a situation of a nozzle when a tube is pushed out from a guide pipe, a situation of a nozzle when an injection pipe is slightly pushed out from a guide pipe, and a situation of a nozzle when an injection pipe is pulled in a guide pipe.

As shown in FIG. 1 and FIGS. 2(*a*), (*b*), and (*c*), an injector 1 of the present Embodiment is an injector for a fertilized ovum(ova) or a sperm(s) for injecting a fertilized ovum(ova) or a sperm(s) for artificial insemination to a mammal such as a cow, and comprises in general a guide pipe 2 for insertion into a uterine body, an injection pipe 3 inserted in the guide pipe 2, and a fluid supplier 8 such as a syringe connected through a cylindrical connector 6 to the rear side of the injection pipe 3. The guide pipe 2 is a metal pipe comprising a flange 21 provided at the rear part of the pipe, and has high rigidity. The injection pipe 3 is flexible at least at a frontal part, and longer than the guide pipe 2 in size. A nozzle 4 is connected to the frontal end of the injection pipe 3 and the cylindrical connector 6 is connected to the rear end of the injection pipe 3. A fluid supplier 8 is connected to the rear side of the injection pipe 3 through the cylindrical connector 6, and a liquid substance containing a fertilized ovum(ova) or a sperm(s) for artificial insemination is injected in the injection pipe 3 through the cylindrical connector 6. In some cases, a fertilized ovum(ova) or a sperm(s) for artificial insemination may be retained in the cylindrical connector 6, and in such cases the fluid supplier 8 supplies a fluid which makes the fertilized ovum(ova) or a sperm(s) for artificial insemination flow inside the injection pipe 3.

For injecting, for example, a fertilized ovum into the uterine body of a cow using the injector 1 constructed as above, the guide pipe 2 is inserted through the vaginal opening into the uterine body A1 in a state where the injection pipe 3 is pulled in the guide pipe 2 as shown in FIG. 1(*a*). On this occasion, a hand wearing a thin cover made of a plastic film or the like (not illustrated) may be inserted through the anus into the rectum B1 to hold the uterine cervical canal A12 from the rectum B1, thereby guiding the guide pipe 2 into the uterine body A1.

Next, as shown in FIG. 1(*b*), the rear side of the injection pipe 3 is manipulated so as to push out the frontal side of the injection pipe 3 from the front tip of the guide pipe 2, thereby bringing the nozzle 4 to a deep part of the uterine horn A11. Then a piston 81 of the fluid supplier 8 is pressed as shown in FIG. 1(*c*). In this embodiment, the injection pipe 3 or the cylindrical connector 6 retains inside thereof a liquid substance containing a fertilized ovum(ova) or a sperm(s) for artificial insemination, and the fluid supplier 8 is filled with a fluid such as air or a liquid. Hence, the fertilized ovum(ova) or the sperm(s) for artificial insemination retained inside the injection pipe 3 or inside the cylindrical connector 6 is(are) supplied through the injection pipe 3 to the nozzle 4 by the fluid supplied from the fluid supplier 8, and injected from the nozzle 4 to a deep part of the uterine horn A11. Thereafter, the injector 1 is pulled out from the vaginal opening.

In such an injection operation, the guide pipe 2 may be inserted into the uterine body A1 in a state where at least a part of the injector 1 to be inserted into the uterine body A1 is covered with a thin cover made of a plastic film or the like (not illustrated), and thereafter the frontal end of the injector 1 may be protruded out of the cover, and then the injection pipe 3 may be pushed out from the front tip of the guide pipe 2 to bring the nozzle 4 to a deep part of the uterine horn A11.

(Detailed Construction of Injector 1)

Figure 3:
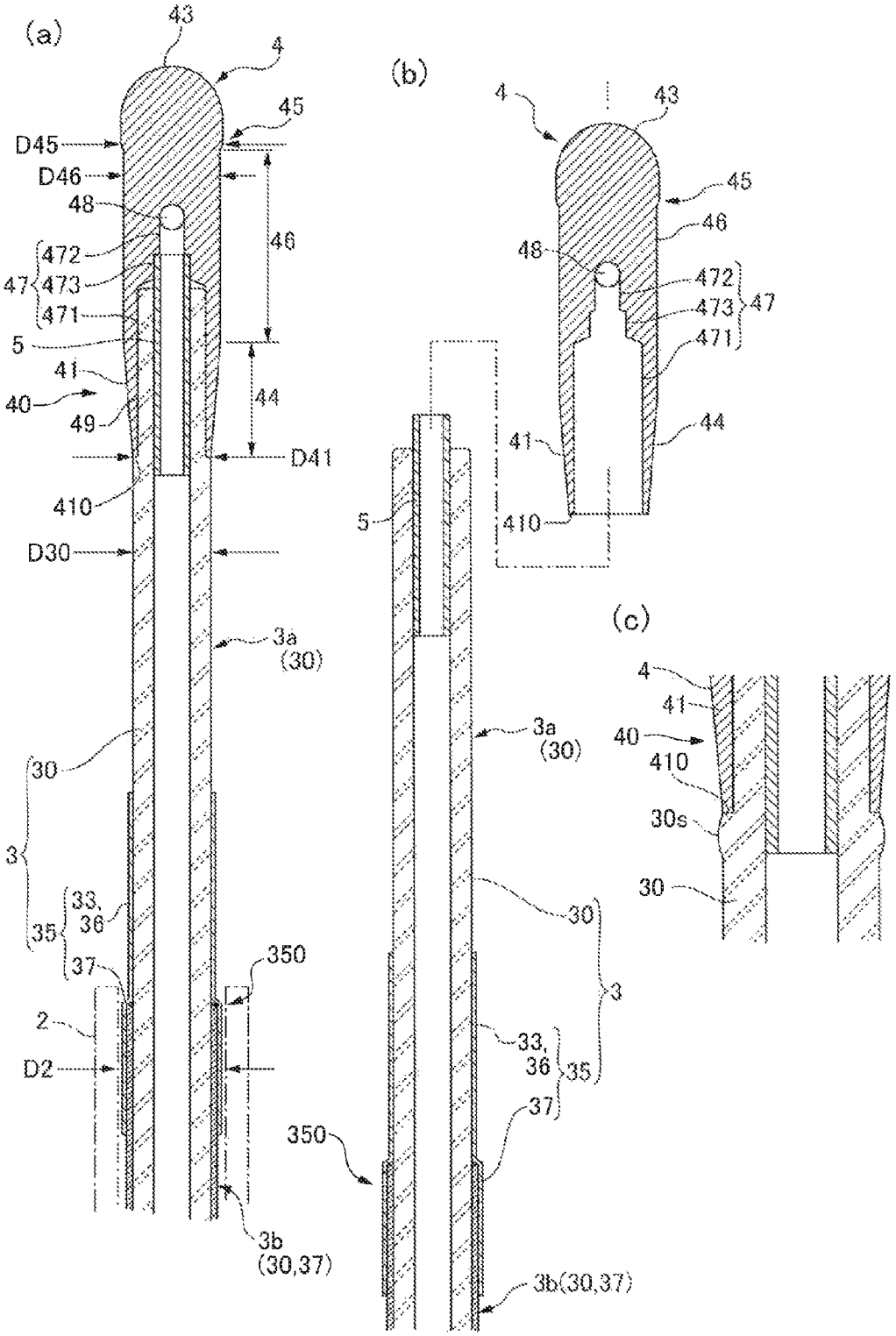
FIG. 3 is cross-sectional views showing a structure of a connection part between a tube and a nozzle, etc. of an injector according to Embodiment 1 of the present invention.

FIG. 3 is cross-sectional views showing a structure of a connection part between the injection pipe 3 and the nozzle 4, etc. of the injector 1 according to Embodiment 1 of the present invention, and FIGS. 3(*a*), (*b*), and (*c*) show, respectively, a situation after the injection pipe 3 and the nozzle 4 are connected to each other, a situation before the injection pipe 3 and the nozzle 4 are connected to each other, and an enlarged view of the connection part between the injection pipe 3 and the nozzle 4.

As shown in FIG. 2(*c*) and FIGS. 3(*a*), (*b*), and (*c*), the injection pipe 3 comprises a flexible tube 30 extending all the length of the injection pipe 3, and the nozzle 4 is connected to the frontal end of the tube 30. The tube 30 is made of a flexible resin such as a silicone resin or a poly(vinyl chloride) resin. In the present Embodiment, a tube 30 made of a silicone resin is preferably used, since it is preferred that the flexibility of the tube 30 be unlikely to be affected by an environmental temperature where the injector 1 is used.

In the present Embodiment, the outside of a portion of the tube 30 located apart from the nozzle 4 toward the rear side is covered with a reinforcing sleeve 35. In the present Embodiment, as the reinforcing sleeve 35, a flexible sleeve 36 which covers the outside of a portion of the tube 30 located apart from the nozzle 4 toward the rear side and a rigid sleeve 37 which covers the outside of the tube 30 on the rear side from the flexible sleeve 36 are used. The flexible sleeve 36 and the rigid sleeve 37 are placed such that they partially overlap.

The length of the tube 30 is larger than the length of the rigid sleeve 37 and the length of the guide pipe 2, and the rear edge of the tube 30 is located at the same position as the rear edge of the rigid sleeve 37. Consequently, in the injection pipe 3, a frontal side of the tube 30 protrudes from the frontal end of the rigid sleeve 37, and a base part of the portion of the tube 30 protruding from the rigid sleeve 37 is covered with the flexible sleeve 36. As a result, the injection pipe 3 has a structure in which the rigidity increases in a stepwise fashion from the frontal side to the rear side.

In the present Embodiment, at an overlapping part 350 of the flexible sleeve 36 and the rigid sleeve 37, the tube 30 is covered with the sleeves such that the flexible sleeve 36 is placed outside the rigid sleeve 37. The rigid sleeve 37 is a rigid pipe made of a metal or a hard resin, and the flexible sleeve 36 is made of a heat-shrinkable resin such as a polyester resin or a poly(vinyl chloride) resin. Consequently, the rigid sleeve 37 has a rigidity higher than the flexible sleeve 36 and the tube 30. The flexible sleeve 36 is placed around the tube 30 by heat-shrinking of a sleeve made of a heat-shrinkable resin. More specifically, the tube 30 is inserted in the rigid sleeve 37 and then inserted in the flexible sleeve 36, and thereafter, the flexible sleeve 36 is heat-shrunk, so that the tube 30 becomes covered with the flexible sleeve 36. Even in such a constitution, the outer diameter size of the injection pipe 3 can be less than the inner diameter size of the guide pipe 2 at any point in a longitudinal direction. Thus, the injection pipe 3 is movable inside the guide pipe 2 in a longitudinal direction. For inserting the tube 30 into the rigid sleeve 37, the tube 30 may be pulled in a longitudinal direction to make its diameter smaller, and in this state the tube 30 may be inserted into the rigid sleeve 37, followed by releasing the tube 30 from the tension.

The injection pipe 3 is connected with a cylindrical connector 6 at the rear part of the rigid sleeve 37. The length of the tube 30 is larger than the length of the guide pipe 2, and the length of the rigid sleeve 37 is slightly larger than the length of the guide pipe 2. Accordingly, when the rear side of the injection pipe 3 (rigid sleeve 37) is manipulated to push forward the rear end of the injection pipe 3 (cylindrical connector 6) such that the rear end of the injection pipe 3 (cylindrical connector 6) contacts the flange 21 of the guide pipe 2, a portion of the tube 30 protruding from the rigid sleeve 37 comes into a state where the portion protruding from the rigid sleeve 37 protrudes from the frontal end of the guide pipe 2.

In contrast to the above, when the injection pipe 3 is pulled toward the rear side by manipulating the rear side of the injection pipe 3 (cylindrical connector 6), the injection pipe 3 is drawn into the guide pipe 2 until a stopping part 45 of the nozzle 4 described below contacts the frontal end of the guide pipe 2 as shown in FIGS. 2(*d*) to (*f*), so that the entire frontal side of the injection pipe 3 is accommodated in the guide pipe 2 in that state.

As described above, in the injector 1 of the present Embodiment, the injection pipe 3 comprises a flexible 1st pipe section 3*a* which constitutes the frontal side of the injection pipe 3, and a 2nd pipe section 3*b* which has a rigidity higher than the 1st pipe section 3*a* and constitutes the rear side of the injection pipe 3. More specifically, the injection pipe 3 comprises a flexible tube 30 which is longer than the guide pipe 2 and is inserted in the guide pipe 2, and a rigid sleeve 37 which is arranged so that the outside of a rear part of the tube 30 is covered with the sleeve 37, leaving a frontal part of the tube 30 in an exposed state. Therefore, in the present Embodiment, the 1st pipe section 3*a* is constituted by a portion of the tube 30 protruding from the rigid sleeve 37 on a frontal side, and the 2nd pipe section 3*b* is constituted by the rigid sleeve 37 and a portion of the tube 30 positioned inside the rigid sleeve 37. The length of the 1st pipe section 3*a* may be approximately from 12 cm to 18 cm.

Both edges of the rigid sleeve 37 are bonded to the tube 30 with an adhesive. More specifically, the frontal end of the rigid sleeve 37 is bonded to the outer peripheral surface of the tube 30 by an adhesive, and the rear end surface of the rigid sleeve 37 and the rear end surface of the tube 30 are bonded together by an adhesive. Therefore, the rigid sleeve 37 and a portion of the tube 30 positioned inside the rigid sleeve 37 are united. As a consequence, when the rear side of the injection pipe 3 (rigid sleeve 37) is manipulated, the tube 30 moves with the rigid sleeve 37 in an integrated manner. The tube 30 and the rigid sleeve 37 may be bonded together through the entire length inside the rigid sleeve 37.

Further, the injection pipe 3 has a reinforcing layer 33 composed of the flexible sleeve 36 which covers a boundary part between the 1st pipe section 3*a* and the 2nd pipe section 3*b*. As a result, the injection pipe 3 has a structure in which the rigidity increases in a stepwise fashion from the frontal side to the rear side.

(External Shape of Nozzle 4)

As shown in FIGS. 2(*d*) to (*f*) and FIGS. 3(*a*), (*b*), the nozzle 4 comprises a stopping part 45 and a connecting cylindrical part 41 connected to the frontal end of the injection pipe 3 on the rear side from the stopping part 45, and there are nozzle holes 48 opening at mutually opposite positions in a side surface of the nozzle 4. A constitution in which a nozzle hole 48 opens at a single position in a side surface of the nozzle 4 may also be adopted. The frontal end 43 of the nozzle 4 is spherical so as not to hurt the inner wall of a uterine body.

In the above-described nozzle 4, the outer diameter size D45 of the stopping part 45 is larger than the inner diameter size D2 of the guide pipe 2, as shown by the following formula:

$$D2<D45$$

D45=Outer diameter size of stopping part 45

D2=Inner diameter size of guide pipe 2

Therefore, the stopping part 45 of the nozzle 4 functions as a stopper, which contacts the frontal end of the guide pipe 2, when the injection pipe 3 is pulled toward the rear side.

A connection part 40 between the nozzle 4 and the injection pipe 3 is constituted such that the frontal end of the injection pipe 3 is inserted into the connecting cylindrical part 41, and the connecting cylindrical part 41 covers the outside of the frontal end of the injection pipe 3. An outer peripheral surface of the connecting cylindrical part 41 is formed into a tapered surface 44 whose diameter decreases continuously toward the rear side. As a result, the outer diameter size D41 of the rear edge 410 of the connecting cylindrical part 41 is reduced to the outer diameter size of the injection pipe 3 (outer diameter size D30 of tube 30) or less as expressed by the following formula:

$$D41\leq D30$$

D41=Outer diameter size of rear edge 410 of connecting cylindrical part 41

D30=Outer diameter size of tube 30

Therefore, no step part which has an outer diameter size larger than the outer diameter size D30 of the injection pipe 3 and faces toward the injection pipe 3 is formed in the connection part 40. In such an Embodiment, when the frontal end of the injection pipe 3 is inserted into the connecting cylindrical part 41, a bulge 30*s* occurs at a part of the tube 30 adjacent to the rear edge 410 of the connecting cylindrical part 41 as shown in FIG. 3(*c*). Therefore, even when the outer diameter size D41 of the rear edge 410 of the connecting cylindrical part 41 is only slightly larger than the outer diameter size of the injection pipe 3 (outer diameter size D30 of tube 30), there occurs no step part in the connection part 40 which has an outer diameter size larger than the outer diameter size D30 of the injection pipe 3 and faces toward the injection pipe 3. Moreover, in the present Embodiment, since the frontal end of the tube 30 is inserted in an annular space 49 between the connecting cylindrical part 41 and the reinforcing pipe for connection 5 in an elastically deformed state as described below, the tube 30 is remarkably deformed and the bulge 30*s* surely occurs at the part adjacent to the rear edge 410 of the connecting cylindrical part 41. Therefore, even when the outer diameter size D41 of the rear edge 410 of the connecting cylindrical part 41 is only slightly larger than the outer diameter size of the injection pipe 3 (outer diameter size D30 of tube 30), there appears no step part, which has an outer diameter size larger than the outer diameter size D30 of the injection pipe 3 and faces toward the injection pipe 3, in the connection part 40.

In the nozzle 4 of the present Embodiment, a trunk 46 extending with a constant outer diameter size D46 is formed between the tapered surface 44 and the stopping part 45, and the outer diameter size D46 of the trunk 46 is larger than the outer diameter size D41 of the rear edge 410 of the connecting cylindrical part 41 and the outer diameter size D30 of the injection pipe 3, and smaller than the inner diameter size D2 of the guide pipe 2 and the outer diameter size D45 of the stopping part 45, as expressed by the following formula:

$$D41\leq D30<D46<D2<D45$$

The stopping part 45 is formed by a portion of the nozzle 4, the outer diameter size of which increases continuously from a rear side toward a frontal side, and in the vicinity of the stopping part 45, any step part which has an outer diameter size larger than the outer diameter size D30 of the injection pipe 3 and faces toward the injection pipe 3 is not formed. That means, a portion between the stopping part 45 and the trunk 46 has a slope shape such as a tapered surface which increases the diameter from the side of the trunk 46 toward the stopping part 45, and comprises no step having an edge surface at a right angle to the axis direction. Further, between the trunk 46 and the tapered surface 44, a step part having an outer diameter size larger than the outer diameter size D30 of the injection pipe 3 and facing toward the injection pipe 3 is not formed. Therefore, a portion ranging from the connection part 40 between the injection pipe 3 and the connecting cylindrical part 41 to the stopping part 45 extends without any step part having an outer diameter size larger than the outer diameter size D30 of the injection pipe 3 and facing toward the injection pipe 3.

(Connection Structure between Nozzle 4 and Injection Pipe 3)

In the present Embodiment, for connecting the nozzle 4 with the injection pipe 3, a connection part 40 with a structure in which the frontal end of the injection pipe 3 is inserted in the connecting cylindrical part 41 is constituted, and a hollow part 47 communicating with the nozzle holes 48 is formed inside the connecting cylindrical part 41. A reinforcing pipe for connection 5 as thin as an injection needle is inserted into the tube 30 at the frontal part of the tube 30, and when the frontal side of the tube 30 is inserted into the connecting cylindrical part 41 (hollow part 47), the frontal end of the tube 30 is inserted in the annular space 49 between the connecting cylindrical part 41 and the reinforcing pipe for connection 5 in an elastically deformed state. The frontal part of the tube 30 may have a shape extending with a constant outer diameter size, or, in order to facilitate insertion into the connecting cylindrical part 41, a tapered surface may be formed in advance on the entire circumference of the frontal part of the tube 30 such that the diameter of the tube 30 decreases toward the frontal tip.

In the hollow part 47 of the nozzle 4, a large diameter part 471 into which the frontal end of the tube 30 is inserted and a small diameter part 472 which communicates with the nozzle holes 48 are formed, and a reinforcing pipe holding part 473 having a middle inner diameter size that is approximately the same as the outer diameter size of the reinforcing pipe for connection 5 is formed between the large diameter part 471 and the small diameter part 472. More specifically, the reinforcing pipe for connection 5 protrudes partially from the frontal end of the tube 30, and when the frontal side of the tube 30 is inserted in the connecting cylindrical part 41 (hollow part 47) in a state where the reinforcing pipe for connection 5 is inserted into the frontal end of the tube 30, the frontal end of the reinforcing pipe for connection 5 is inserted and retained in the reinforcing pipe holding part 473.

In connecting the nozzle 4 with the injection pipe 3, when the frontal end of the tube 30 is inserted into the connecting cylindrical part 41, a method utilizing mutual fitting between the components without using an adhesive may be employed, or, when the frontal end of the tube 30 is inserted into the connecting cylindrical part 41, a method in which an adhesive is applied beforehand to the outer peripheral surface of the frontal part of the tube 30, the outer peripheral surface of the reinforcing pipe for connection 5, and the inner circumferential surface of the large diameter part 471, etc., may be employed. Further, when inserting the reinforcing pipe for connection 5 into the tube 30, a method utilizing mutual fitting between the components without using an adhesive may be employed, or, when the reinforcing pipe for connection 5 is inserted into the frontal end of the tube 30, a method in which an adhesive is applied beforehand to the inner circumferential surface of the frontal part of the tube 30 and the outer peripheral surface of the reinforcing pipe for connection 5 may be employed. Since the reinforcing pipe for connection 5 is inserted into the frontal end of the tube 30, even in cases where an adhesive is applied to the outer peripheral surface of the frontal end of the tube 30, the outer peripheral surface of the reinforcing pipe for connection 5, the inner circumferential surface of the large diameter part 471, and the inner circumferential surface of the frontal part of the tube 30, the adhesive is not exposed to a flow channel of the injection pipe 3. Consequently, decrease in the conception rate to be caused by a contact between an adhesive and a fertilized ovum(ova) or a sperm(s) does not occur.

(Constitution of Cylindrical Connector 6)

Figure 4:
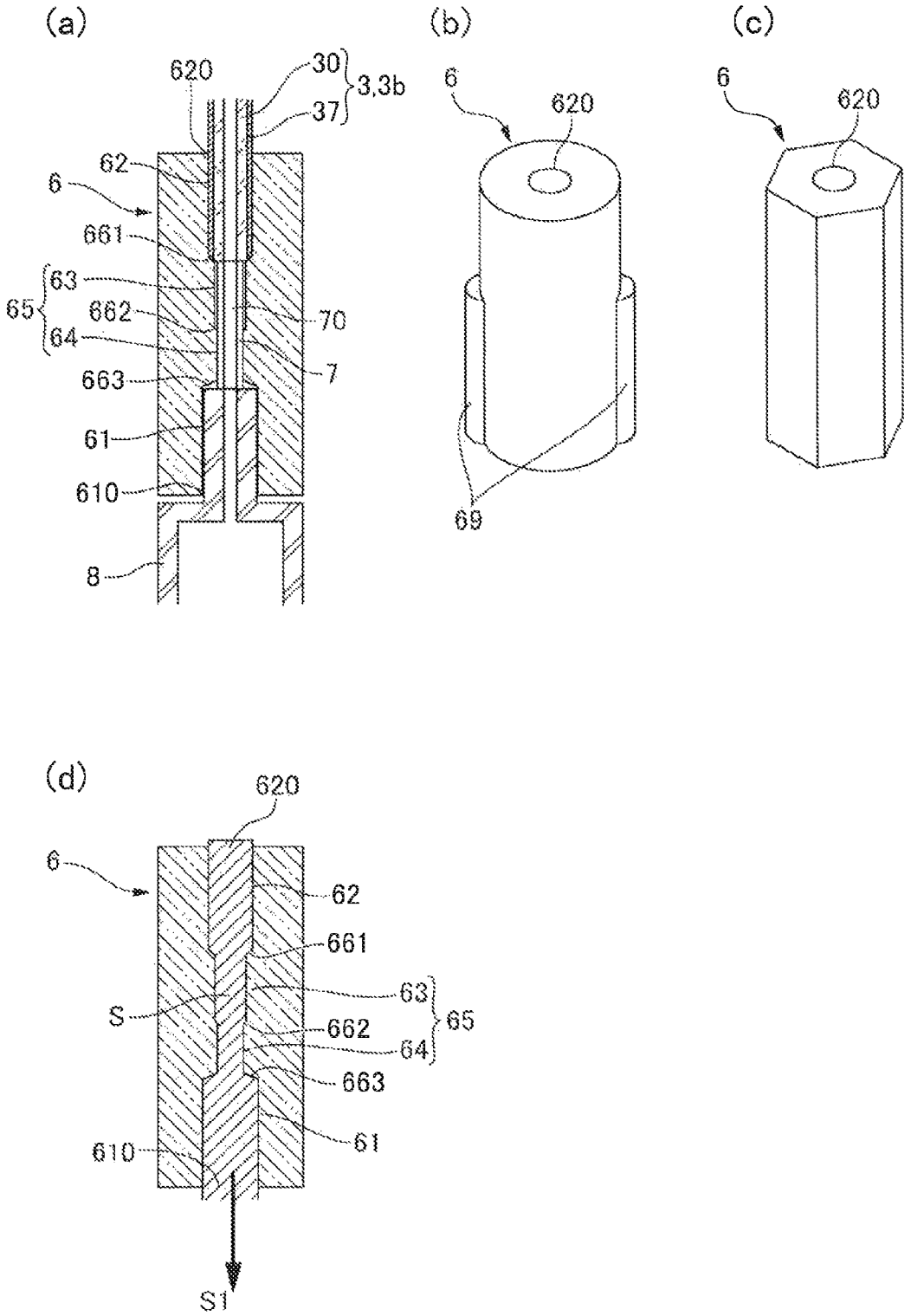
FIG. 4 is diagrams of a cylindrical connector used in an injector according to Embodiment 1 of the present invention.

FIG. 4 is diagrams of a cylindrical connector 6 used in an injector according to Embodiment 1 of the present invention, and FIGS. 4(*a*), (*b*), (*c*), and (*d*) show, respectively, a cross-section of the cylindrical connector 6, the appearance of the cylindrical connector 6, the appearance of another cylindrical connector 6, and a production method of a cylindrical connector 6.

As shown in FIG. 4(*a*), a cylindrical connector 6 is a cylindrical element having openings of connecting ports 610, 620 at both ends, and may be an integrally molded item made of a thermosetting rubber such as a silicone rubber. To the connecting ports 610, 620, the fluid supplier 8 and the 2nd pipe section 3*b* of the injection pipe 3 (rigid sleeve 37) are connected, respectively. In the present Embodiment, the connecting port 610 to which the fluid supplier 8 is connected has a larger inner diameter compared to the connecting port 620 to which the injection pipe 3 is connected.

Inside the cylindrical connector 6, a small diameter part 65 is arranged between the large diameter part 61 connected to the connecting port 610 and the middle diameter part 62 connected to the connecting port 620, and the small diameter part 65 has a smaller diameter than the middle diameter part 62. The cylindrical connector 6 having such a constitution is used for connecting the injection pipe 3 and the fluid supplier 8 when a fertilized ovum(ova) or a sperm(s) for artificial insemination charged inside the injection pipe 3 is supplied to the nozzle 4. Further, the cylindrical connector 6 may also be used for charging a fertilized ovum(ova) or a sperm(s) for artificial insemination inside the injection pipe 3. Furthermore, in some cases, a straw 7 in which a fertilized ovum(ova) or a sperm(s) for artificial insemination is(are) retained may be loaded inside the the cylindrical connector 6 itself. In such cases, the straw 7 is held by the fluid supplier 8 and the injection pipe 3 from both sides in a state of being placed in the small diameter part 65. Therefore, when a fluid is supplied from the fluid supplier 8, a fertilized ovum(ova) retained in the straw 7 together with an embryo medium is(are) transferred to the injection pipe 3, and supplied to the nozzle 4 through the injection pipe 3. In some other cases, the straw 7 may be connected between the cylindrical connector 6 and the injection pipe 3, or between the cylindrical connector 6 and the fluid supplier 8, and in this state a fluid may be supplied from the fluid supplier 8.

In the present Embodiment, the small diameter part 65 is composed of a 1st small diameter part 63 positioned on the side of the connecting port 620 and a 2nd small diameter part 64 which has an inner diameter smaller than the 1st small diameter part 63 and is positioned between the 1st small diameter part 63 and the large diameter part 61. Therefore, a plurality of small step parts 661, 662, 663 are formed on an inner circumferential surface of the cylindrical connector 6, by which the inner diameter size is enlarged at both sides of the central portion (2nd small diameter part 64) in an axis line direction, and no large step part is formed. Furthermore, the cylindrical connector 6 is made of a thermosetting rubber such as a silicone rubber, and has suitable flexibility (elasticity) and rigidity immediately after molding. Therefore, the cylindrical connector 6 can be produced by a so-called forced demolding method, in which a stepped rod-like part S, a mold for forming a hollow part of a cylindrical connector 6, is pulled out through the connecting port 610 as shown by the arrow S1 in FIG. 4(*d*) when a cylindrical connector 6 is molded. Consequently, a cylindrical connector 6 can be produced with a low-cost mold, and therefore cost reduction of the cylindrical connector 6 can be attained. According to the present Embodiment, the step heights of the step parts 661, 662, 663 are low. Therefore, not only in the case where a cylindrical connector 6 is produced with a flexible resin such as a silicone rubber or a silicone resin, the so-called forced demolding method can be employed also in the case where the cylindrical connector 6 is produced with a resin which does not have flexibility after cooling, as long as the resin has some flexibility immediately after molding.

The outer peripheral surface of the cylindrical connector 6 may have a shape for preventing rotation of the cylindrical connector 6. More specifically, although the cylindrical connector 6 is as a whole cylindrical as shown in FIG. 4(*b*), rib-like projections 69 extending in an axis line direction are formed on the outer peripheral surface. By such a structure, the cylindrical connector 6 does not roll on a work table, etc., which is convenient for handling. The rib-like projections 69 are formed only in an axis line direction on the side where the connecting port 610 is formed, and do not extend up to the side where the connecting port 620 is formed. Therefore, only by checking the position of the rib-like projection 69, the side of the cylindrical connector 6 where the fluid supplier 8 is to be connected and the side where the injection pipe 3 is to be connected can be easily discriminated. From a viewpoint of prevention of rotation of a cylindrical connector 6, the external shape of a cylindrical connector 6 may be multangular such as hexagonal as shown in FIG. 4(*c*).

(Main Effects of the Present Embodiment)

As described above, in using the injector 1 according to the present Embodiment, the guide pipe 2 is inserted through a vaginal opening into a uterine body in a state where the injection pipe 3 is pulled in the guide pipe 2, and then the injection pipe 3 is pushed out from the front tip of the guide pipe 2 so as to bring the nozzle 4 to a deep part of the uterine body. Then a fertilized ovum(ova) or a sperm(s) is(are) supplied through the injection pipe 3 to the nozzle 4 by means of a fluid supplied from the fluid supplier 8 and discharged from the nozzle 4. Thereafter the injector 1 is pulled out carefully from the vaginal opening.

A portion of the injection pipe 3 which protrudes from the front tip of the guide pipe 2 when the injection pipe 3 is pushed out toward the frontal side is a flexible 1st pipe section 3*a* composed of the tube 30, and therefore the nozzle 4 arranged at the frontal side of the 1st pipe section 3*a* can reach a deep part of the uterine horn A11. During the action, a uterus inner wall is not wounded because the 1st pipe section 3*a* is flexible. Moreover, since a rear part of the injection pipe 3 protruding from the rear part of the guide pipe 2 is a 2nd pipe section 3*b*, which is more rigid than the 1st pipe section 3*a*, buckling of the 2nd pipe section 3*b* does not take place when the 2nd pipe section 3*b* is manipulated to push out the injection pipe 3 from the front tip of the guide pipe 2. Thus, the frontal side of the injection pipe 3 can be pushed out smoothly from the guide pipe 2 into the uterus, and therefore the operability in injecting a fertilized ovum (ova) or a sperm(s) is superior. Hence, an injection operation of a fertilized ovum(ova) or a sperm(s) can be performed efficiently according to the present Embodiment.

The injection pipe 3 comprises a flexible tube 30 which is longer than the guide pipe 2 and is inserted in the guide pipe 2, and a rigid sleeve 37 which is arranged so that the outside of a rear part of the tube 30 is covered with the sleeve 37, leaving a frontal part of the tube 30 in an exposed state. Therefore, in the present Embodiment, the 1st pipe section 3*a* is constituted by a portion of the tube 30 protruding from the rigid sleeve 37 on a frontal side, and the 2nd pipe section 3*b* is constituted by the rigid sleeve 37 and a portion of the tube 30 positioned inside the rigid sleeve 37. Therefore, by using a clean tube as the tube 30, contamination of a fertilized ovum(ova) or a sperm(s) can be prevented. Further, since a flexible tube 30 functions as a heat insulating material, impairment of the activity of a fertilized ovum (ova) or a sperm(s) due to overcooling will not occur even when an injection operation is carried out in a low temperature atmosphere, e.g., in wintertime.

Since at least the frontal end of the rigid sleeve 37 is bonded to the outer peripheral surface of the tube 30 by an adhesive, a portion of the tube 30 positioned inside the rigid sleeve 37 moves with the rigid sleeve 37 in an integrated manner when the rigid sleeve 37 is manipulated. Further, an injection pipe 3 is flexible only at the 1st pipe section 3*a*. Therefore, when the rear side of the 2nd pipe section 3*b* (rigid sleeve 37) of the injection pipe 3 is manipulated to be pushed forward, the nozzle 4 accurately follows the manipulation and moves toward a deep part of the uterus. Consequently, the injector 1 of the present Embodiment is superior in operability.

A cylindrical connector 6 is connected to the rear part of the 2nd pipe section 3*b*. Therefore, the fluid supplier 8 for supplying a fluid for transporting a fertilized ovum(ova) or a sperm(s) to the nozzle 4 can be connected to the rear side of the injection pipe 3 via the cylindrical connector 6, and thus the fluid supplier 8 can be easily connected to the injection pipe 3. Further, since the cylindrical connector 6 is connected to the 2nd pipe section 3*b* having a high rigidity, a situation where the fluid supplier 8 hangs down will not occur. Therefore, the injector of the present Embodiment has the advantage that the fluid supplier 8 is easy to handle.

Further, since the nozzle 4 comprises a stopping part 45 having an outer diameter size larger than the inner diameter size of the guide pipe 2, the nozzle 4 is not pulled into the guide pipe 2 when the injection pipe 3 is pulled into the guide pipe 2.

The stopping part 45 is formed such that the outer diameter size increases continuously from a rear side toward a frontal side. At the connection part 40 between the injection pipe 3 and the nozzle 4, the frontal end of the injection pipe 3 is inserted into the connecting cylindrical part 41. On the outer peripheral surface of the connecting cylindrical part 41, a tapered surface 44 is formed, which reduces the diameter continuously toward the rear side so that the outer diameter size of the rear edge of the connecting cylindrical part 41 is reduced to the outer diameter size of the injection pipe 3 or less. Therefore, a portion ranging from the connection part 40 between the injection pipe 3 and the connecting cylindrical part 41 of the nozzle 4 to the stopping part 45 does not comprise any step part having an outer diameter size larger than the outer diameter size of the injection pipe 3. Therefore, when the injector 1 is pulled out from the vaginal opening after injection of a fertilized ovum(ova), such a situation where the uterus inner wall is wounded by a step will not occur. Further, such a situation where the fertilized ovum(ova) is(are) caught and scraped out by a step will not occur. Therefore, the conception rate can be improved. Further, since there is no step, the stopping part 45 gradually comes to a plugged state in the guide pipe 2 when the injection pipe 3 is pulled into the guide pipe 2. Consequently, such a situation where a strong force is suddenly given to the nozzle 4 is not occur, and thus the connection strength between the nozzle 4 and the injection pipe 3 is not compromised. Therefore, the nozzle 4 can be prevented from falling off from the injection pipe 3 and remaining in a uterine body.

At the frontal end of the injection pipe 3, the reinforcing pipe for connection 5 is inserted into the injection pipe 3, and the frontal end of the injection pipe 3 is fitted into the annular space 49 between the reinforcing pipe for connection 5 and the connecting cylindrical part 41. As a consequence, even when the injection pipe 3 is pushed into the connecting cylindrical part 41 of the nozzle 4, a situation where the injection pipe 3 is squashed will not occur, and therefore a flow channel can be secured. In addition, since the injection pipe 3 is fitted in the annular space 49 between the connecting cylindrical part 41 of the nozzle 4 and the reinforcing pipe for connection 5, the connection strength between the nozzle 4 and the injection pipe 3 is high. Therefore, the nozzle 4 can be securely prevented from falling off from the injection pipe 3.

Further, a reinforcing pipe holding part 473 which holds the frontal end of the reinforcing pipe for connection 5 is arranged inside the the nozzle 4. Since the injection pipe 3 is fitted in the annular space 49 between the connecting cylindrical part 41 of the nozzle 4 and the reinforcing pipe for connection 5 held by the nozzle 4, the connection strength between the nozzle 4 and the injection pipe 3 is high. Therefore, the nozzle 4 can be securely prevented from falling off from the injection pipe 3.

The injection pipe 3 comprises a flexible tube 30 and a reinforcing sleeve 35 covering the outside of a portion of the tube 30 located apart from the nozzle 4 toward the rear side. Further, as a reinforcing sleeve 35, a flexible sleeve 36 and a rigid sleeve 37 placed on the rear side of the flexible sleeve 36 cover the tube 30. Therefore, the injection pipe 3 is covered with the reinforcing layer 33 composed of the flexible sleeve 36 at a boundary part between the 1st pipe section 3*a* and the 2nd pipe section 3*b* to form a constitution in which the rigidity of the injection pipe 3 increases from the frontal side to the rear side. Therefore, buckling is unlikely to occur at the frontal side of the injection pipe 3 when the injection pipe 3 is pushed out from the guide pipe 2, and thus the frontal end of the injection pipe 3 (nozzle 4) can be easily advanced to a deep part of a uterine body.

[Embodiment 2]

Figure 5:
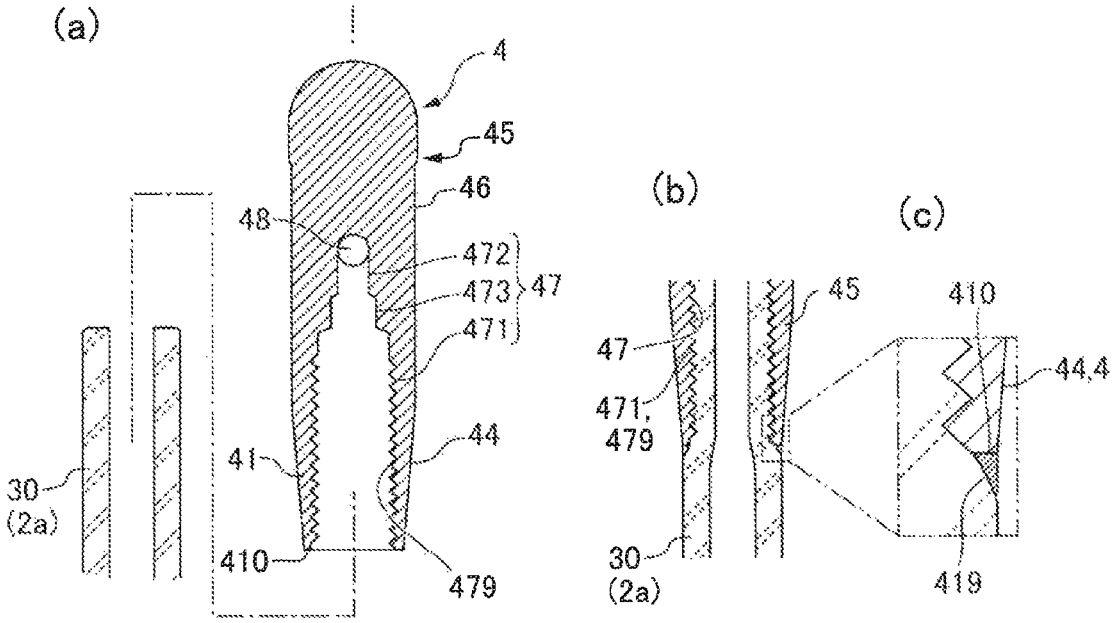
FIG. 5 is diagrams of an injector according to Embodiment 2 of the present invention.

FIG. 5 is diagrams of an injector 1 according to Embodiment 2 of the present invention. FIGS. 5 (*a*), (*b*), and (*c*) show, respectively, a cross-sectional structure before connecting the injection pipe 3 and the nozzle 4 with each other, a cross-sectional structure in the vicinity of the rear edge 410 of the nozzle 4, and an enlarged view of the cross-sectional structure in the vicinity of the rear edge 410. Since the basic constitution of the present Embodiment is similar to Embodiment 1, the corresponding components are denoted by the same reference symbols and detailed description of them is omitted.

Although in Embodiment 1 a reinforcing pipe for connection 5 is used for connecting the injection pipe 3 (tube 30) and the nozzle 4, in the present Embodiment as shown in FIGS. 5(*a*) and (*b*) a reinforcing pipe for connection 5 is not used and a thread groove 479 is formed on the inner circumferential surface of the large diameter part 471 in the hollow part 47 of the nozzle 4. Therefore, according to the present Embodiment, an adhesive is applied to the inner circumferential surface of the large diameter part 471 and then the tube 30 is screwed into the hollow part 47 of the nozzle 4, followed by hardening of the adhesive. As a result, the tube 30 is fixed adhesively in a state where the outer peripheral surface has bitten into the thread groove 479. In this case, an annular concavity 419 formed by the rear edge 410 of the connecting cylindrical part 41 and the outer peripheral surface of the tube 30 is utilized as an adhesive reservoir as shown in FIG. 5(*c*).

[Embodiment 3]

Figure 6:
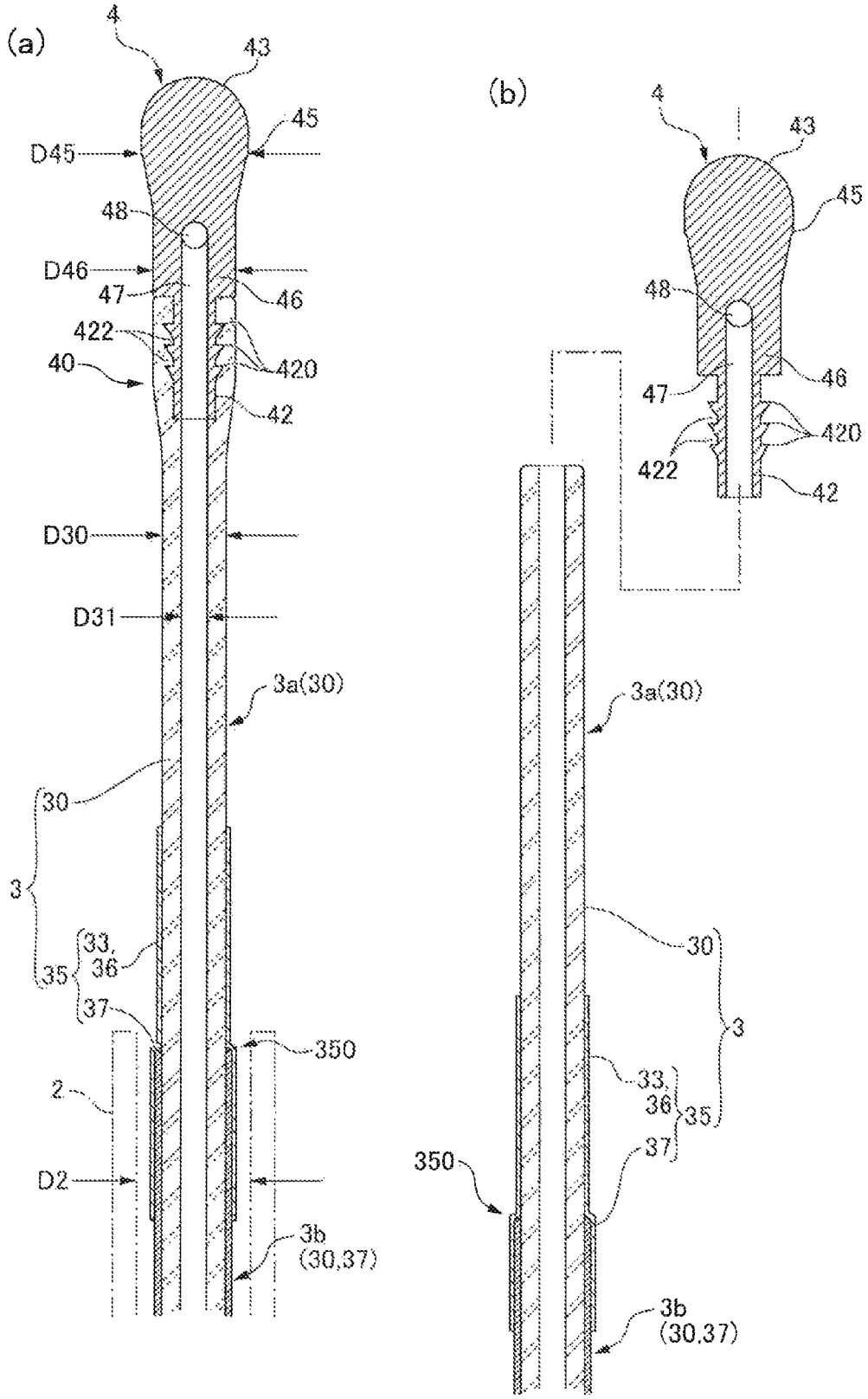
FIG. 6 is diagrams of an injector according to Embodiment 3 of the present invention.

FIG. 6 is diagrams of the injector 1 according to Embodiment 3 of the present invention, and FIGS. 6(*a*) and (*b*) show, respectively, a cross-sectional structure after connecting the injection pipe 3 and the nozzle 4 with each other, and a cross-sectional structure before connecting the injection pipe 3 and the nozzle 4. Since the basic constitutions of the present Embodiment and the below-described Embodiments 4 to 10 are similar to Embodiment 1, the corresponding components are denoted by the same reference symbols and detailed description of them is omitted.

As shown in FIG. 6, in an injector 1 of the present Embodiment, an injection pipe 3 comprises a flexible tube 30 extending all the length of the injection pipe 3, and the nozzle 4 is connected to the frontal end of the tube 30. The nozzle 4 comprises the stopping part 45, and the connecting cylindrical part 42 connected to the frontal end of the injection pipe 3 on a rear side of the stopping part 45. The frontal end 43 is spherical so as not to hurt the inner wall of a uterine body. Further, a trunk 46 is formed between the stopping part 45 and the connecting cylindrical part 42.

In the nozzle 4 having such a structure, the outer diameter size D45 of the stopping part 45 is larger than the inner diameter size D2 of the guide pipe 2, and the stopping part 45 of the nozzle 4 functions as a stopper which contacts the frontal end of the guide pipe 2 when the injection pipe 3 is pulled toward the rear side.

According to the present Embodiment, a connection part 40 between the nozzle 4 and the injection pipe 3 is constituted such that a connecting cylindrical part 42 is inserted into the injection pipe 3, and the injection pipe 3 covers the outside of the connecting cylindrical part 42. Hence, in the connection part 40, no step part which has an outer diameter size larger than the outer diameter size of the injection pipe 3 and faces toward the injection pipe 3 is formed. The connecting cylindrical part 42 has a shape in which a single protruding part 420 or a plurality of protruding parts 420 are formed on the outer peripheral surface of a cylindrical part having an outer diameter size approximately the same as the inner diameter size of the injection pipe 3 (inner diameter size D31 of tube 30). Consequently, when the connecting cylindrical part 42 is inserted into the injection pipe 3, the protruding parts 420 come to bite into the injection pipe 3 (tube 30). As a consequence of formation of the protruding parts 420, recessed parts 422 that are to be bitten into by the injection pipe 3 (tube 30) are formed on the outer peripheral surface of the connecting cylindrical part 42. According to the present Embodiment, the protruding parts 420 have a cross-sectional shape of approximately right-angled triangle with the hypotenuse facing the rear side where the injection pipe 3 extends. Therefore, in the case where the protruding parts 420 are formed on the outer peripheral surface of the connecting cylindrical part 42, the connecting cylindrical part 42 can be easily inserted into the injection pipe 3. In addition, since the protruding parts 420 wedge into the flexible tube 30, a strong resistance force is exhibited against a force for pulling the connecting cylindrical part 42 out of the injection pipe 3. Although in FIG. 6 the protruding parts 420 and the recessed parts 422 are formed on the connecting cylindrical part 42 at a plurality of positions in an axis line direction, a constitution in which a protruding part 420 and/or a recessed part 422 is(are) formed each at a single position may also be adopted. The protruding part 420 and the recessed part 422 may have a circumferentially linked annular shape, or a spiral shape.

The stopping part 45 is formed by a portion of the nozzle 4 whose outer diameter size increases continuously from the rear side toward the frontal side, and any step part which has an outer diameter size larger than the outer diameter size D30 of the injection pipe 3 and faces toward the injection pipe 3 is not formed in the vicinity of the stopping part 45. That means, a portion between the stopping part 45 and the trunk 46 has a slope shape such as a tapered surface which increases the diameter from the side of the trunk 46 toward the stopping part 45, and comprises no step having an edge surface at a right angle to the axis direction. Although the outer diameter size D46 of the trunk 46 is larger than the outer diameter size D30 of the injection pipe 3, the outer diameter size of a portion of the injection pipe 3 which covers the connecting cylindrical part 42 is the same as the outer diameter size D46 of the trunk 46, or slightly larger than the outer diameter size D46 of the trunk 46. Hence, a boundary part between the trunk 46 and the injection pipe 3 also comprises no step part which has an outer diameter size larger than the outer diameter size of the injection pipe 3 and faces toward the injection pipe 3. Therefore, a portion ranging from the connection part 40 between the injection pipe 3 and the connecting cylindrical part 41 to the stopping part 45 does not comprise any step part which has an outer diameter size larger than the outer diameter size D30 of the injection pipe 3 and faces toward the injection pipe 3.

In connecting the nozzle 4 with the injection pipe 3, when the frontal part of the tube 30 is placed around the connecting cylindrical part 42, a method utilizing mutual fitting between the components without using an adhesive may be employed, or, when the frontal part of the tube 30 is placed around the connecting cylindrical part 42, a method in which an adhesive is applied beforehand to the inner circumferential surface of the frontal part of the tube 30 and/or the outer peripheral surface of the connecting cylindrical part 42, etc., may be employed. In this case, since the frontal part of the tube 30 covers the outside of the connecting cylindrical part 42, the adhesive is not exposed to a flow channel of the injection pipe 3 even when an adhesive is applied to the inner circumferential surface of the frontal part of the tube 30 or the outer peripheral surface of the connecting cylindrical part 42. Therefore, decrease in the conception rate due to a contact between an adhesive and a fertilized ovum(ova) or a sperm(s) does not take place.

As described above, in the injector 1 of the present Embodiment, similarly to Embodiment 1, the stopping part 45 is formed such that the outer diameter size increases continuously from a rear side toward a frontal side. At the connection part 40 between the injection pipe 3 and the nozzle 4, the frontal part of the injection pipe 3 is placed around the connecting cylindrical part 42. Therefore, a portion ranging from the connection part 40 between the injection pipe 3 and the connecting cylindrical part 42 of the nozzle 4 to the stopping part 45 extends without any step part having an outer diameter size larger than the outer diameter size of the injection pipe 3 and facing toward the injection pipe 3. Therefore, when the injector 1 is pulled out from the vaginal opening after injection of a fertilized ovum(ova), such a situation where the uterus inner wall is wounded by a step will not occur. Further, such a situation where the fertilized ovum(ova) is(are) caught and scraped out by a step will not occur. Therefore, the conception rate can be improved. Furthermore, since the outer diameter size of the stopping part 45 enlarges continuously from a rear side toward a frontal side, the stopping part 45 gradually comes to a plugged state in the guide pipe 2 when the injection pipe 3 is pulled into the guide pipe 2. Consequently, such a situation where a strong force is suddenly given to the nozzle 4 is not occur, and thus the connection strength between the nozzle 4 and the injection pipe 3 is not compromised. Therefore, the nozzle 4 can be prevented from falling off from the injection pipe 3 and remaining in a uterine body.

Since the protruding parts 420 which bite into the inner surface of the injection pipe 3, and/or the recessed parts 422 which are bitten into by the injection pipe 3 (tube 30) are formed on the outer peripheral surface of the connecting cylindrical part 42, the connection strength between the injection pipe 3 and the nozzle 4 is high. Therefore, the nozzle 4 can be surely prevented from falling off from the injection pipe 3 and remaining in a uterine body.

In the injector 1 of the present Embodiment, similarly to Embodiment 1, the injection pipe 3 comprises a flexible 1st pipe section 3*a* constituting the frontal side of the injection pipe 3, and a 2nd pipe section 3*b* having a rigidity higher than the 1st pipe section 3*a* and constituting the rear side of the injection pipe 3. More specifically, the injection pipe 3 comprises a flexible tube 30 which is longer than the guide pipe 2 and is inserted in the guide pipe 2, and a rigid sleeve 37 which is arranged so that the outside of a rear part of the tube 30 is covered with the sleeve 37, leaving a frontal part of the tube 30 in an exposed state. Therefore, in the present Embodiment, the 1st pipe section 3*a* is constituted by a portion of the tube 30 protruding from the rigid sleeve 37 on a frontal side, and the 2nd pipe section 3*b* is constituted by the rigid sleeve 37 and a portion of the tube 30 positioned inside the rigid sleeve 37. The injection pipe 3 has a reinforcing layer 33 composed of the flexible sleeve 36 which covers a boundary part between the 1st pipe section 3*a* and the 2nd pipe section 3*b*. As a result, the injection pipe 3 has a structure in which the rigidity increases in a stepwise fashion from the frontal side to the rear side. Therefore, in manipulating the injection pipe 3, buckling does not occur at the 2nd pipe section 3*b*, as well as similar effects as Embodiment 1 are exhibited, for example, buckling is unlikely to occur at the frontal side of the injection pipe 3.

[Embodiment 4]

Figure 7:
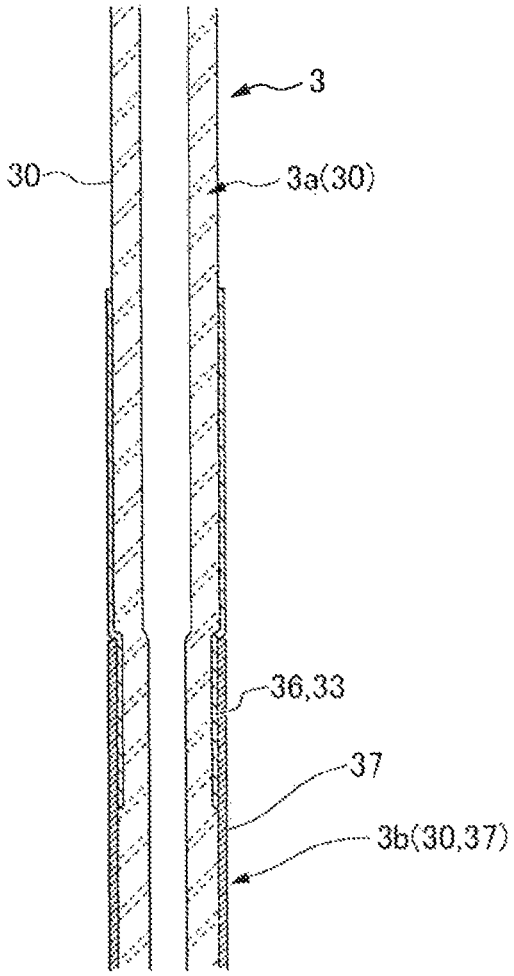
FIG. 7 is a diagram of an injector according to Embodiment 4 of the present invention.

FIG. 7 is a diagram of an injector 1 according to Embodiment 4 of the present invention showing an enlarged cross-sectional view of a boundary part between the 1st pipe section 3*a* and the 2nd pipe section 3*b*.

According to Embodiments 1 to 3, in providing a reinforcing layer 33 on a boundary part between the 1st pipe section 3*a* and the 2nd pipe section 3*b*, a flexible sleeve 36 is arranged so that the outside of the tube 30 and the outside of the rigid sleeve 37 are covered with the flexible sleeve 36. In contrast, according to the present Embodiment, as shown in FIG. 7, the outside of the tube 30 is covered with a flexible sleeve 36 made of a heat-shrinkable resin to provide a reinforcing layer 33, and the outside of the flexible sleeve 36 (reinforcing layer 33) is covered with a rigid sleeve 37. Also in such a constitution, a structure in which the rigidity of the injection pipe 3 increases in a stepwise fashion from the frontal side to the rear side is attained. Therefore, similar effects as Embodiment 1 are exhibited in manipulating the injection pipe 3, for example, buckling is unlikely to occur at the frontal side of the injection pipe 3.

[Embodiment 5]

Figure 8:
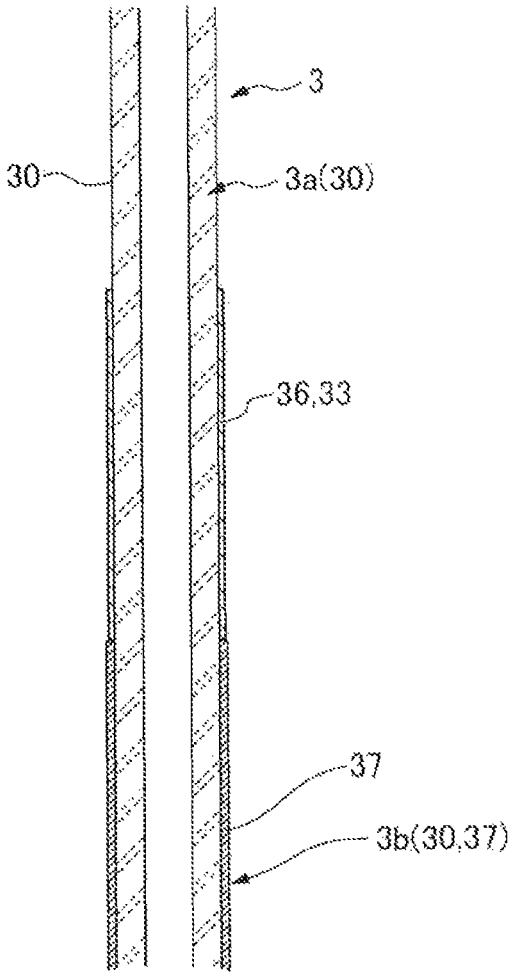
FIG. 8 is a diagram of an injector according to Embodiment 5 of the present invention.

FIG. 8 is a diagram of an injector 1 according to Embodiment 5 of the present invention showing an enlarged cross-sectional view of a boundary part between the 1st pipe section 3*a* and the 2nd pipe section 3*b*.

According to Embodiments 1 to 4, in providing a reinforcing layer 33 on a boundary part between the 1st pipe section 3*a* and the 2nd pipe section 3*b*, a rigid sleeve 37 and a flexible sleeve 36 are arranged so that they partially overlap each other. In contrast, according to the present Embodiment, as shown in FIG. 8, the outside of the tube 30 is covered with a flexible sleeve 36 made of a heat-shrinkable resin to provide a reinforcing layer 33, and the tube 30 is covered with a rigid sleeve 37 at a position adjacent to the flexible sleeve 36 (reinforcing layer 33). Also in such a constitution, a structure in which the rigidity of the injection pipe 3 increases in a stepwise fashion from the frontal side to the rear side is attained. Therefore, similar effects as Embodiment 1 are exhibited in manipulating the injection pipe 3, for example, buckling is unlikely to occur at the frontal side of the injection pipe 3.

A reinforcing layer 33 may also be formed by a coating layer provided outside of the tube 30 instead of the flexible sleeve 36.

[Embodiment 6]

Figure 9:
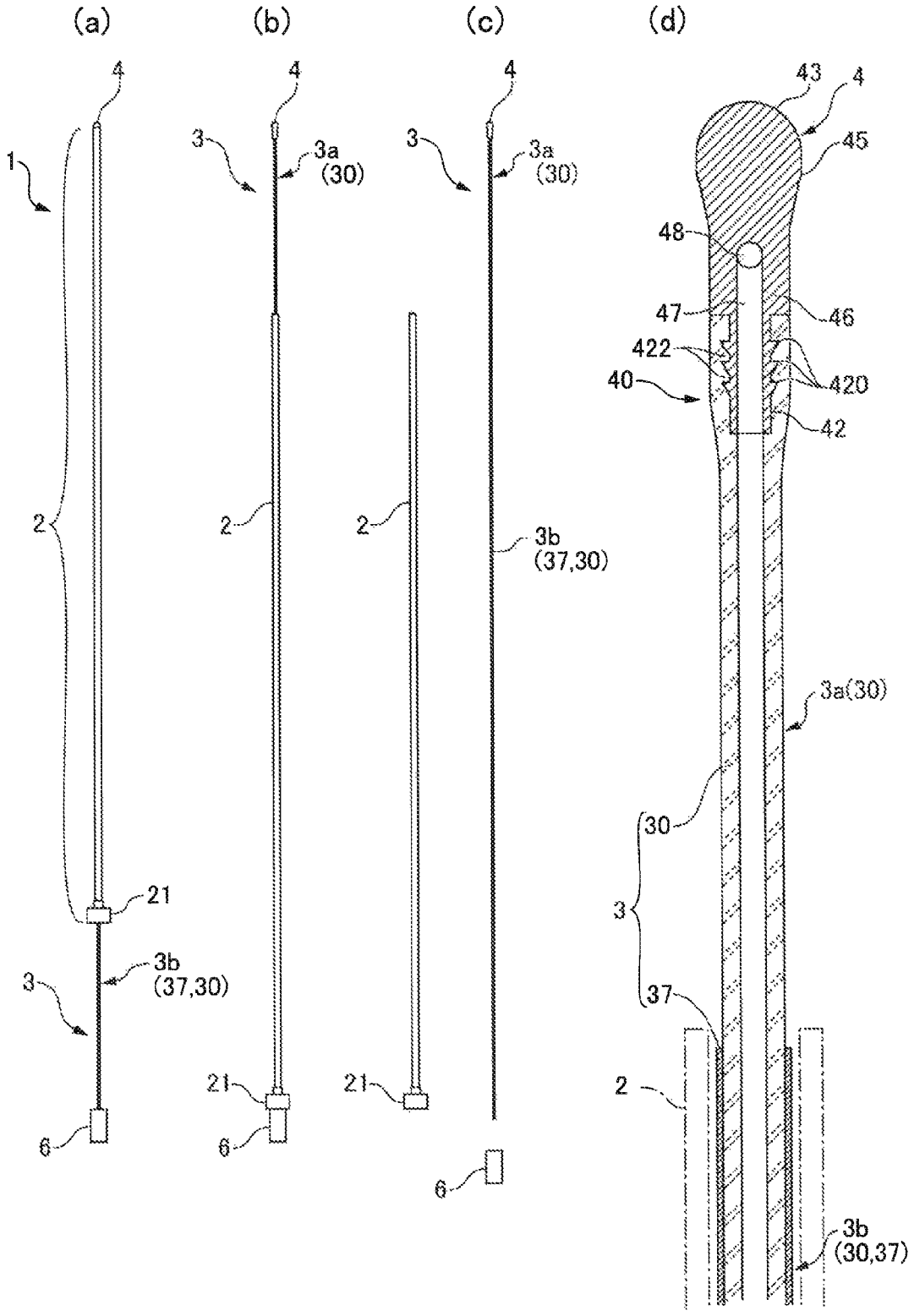
FIG. 9 is diagrams of an injector according to Embodiment 6 of the present invention.

FIG. 9 is diagrams of an injector 1 according to Embodiment 6 of the present invention, and FIGS. 9(*a*), (*b*), (*c*), and (*d*) show a situation where the injection pipe 3 is pulled in the guide pipe 2, a situation where the frontal side of the injection pipe 3 is pushed out from the guide pipe 2, a situation where the injection pipe 3 is pulled out from the guide pipe 2, and a cross-section of the injection pipe 3 etc., respectively.

As shown in FIG. 9, in an injector 1 of the present Embodiment, similarly to Embodiments 1 and 2, the injection pipe 3 comprises a flexible 1st pipe section 3*a* constituting the frontal side of the injection pipe 3, and a 2nd pipe section 3*b* having a rigidity higher than the 1st pipe section 3*a* and constituting the rear side of the injection pipe 3. More specifically, the injection pipe 3 comprises a flexible tube 30 which is longer than the guide pipe 2 and is inserted in the guide pipe 2, and a rigid sleeve 37 which is arranged so that the outside of a rear part of the tube 30 is covered with the sleeve 37, leaving a frontal part of the tube 30 in an exposed state. Therefore, in the present Embodiment, the 1st pipe section 3*a* is constituted by a portion of the tube 30 protruding from the rigid sleeve 37 on a frontal side, and the 2nd pipe section 3*b* is constituted by the rigid sleeve 37 and a portion of the tube 30 positioned inside the rigid sleeve 37. Further, both ends of the rigid sleeve 37 are bonded to the tube 30 with an adhesive. Therefore, similar effects as Embodiment 1 are exhibited in manipulating the injection pipe 3, for example, buckling does not occur at the 2nd pipe section 3*b*.

According to Embodiments 1 and 2, a reinforcing layer 33 is provided on a boundary part between the 1st pipe section 3*a* and the 2nd pipe section 3*b* of the injection pipe 3, whereas, according to the present Embodiment, such a reinforcing layer 33 is not provided. Although in the present Embodiment a constitution in which the reinforcing layer 33 is not used in an injector of Embodiment 2 is illustrated, a constitution in which the reinforcing layer 33 is not used in an injector of Embodiment 1 may also be adopted.

[Embodiment 7]

Figure 10:
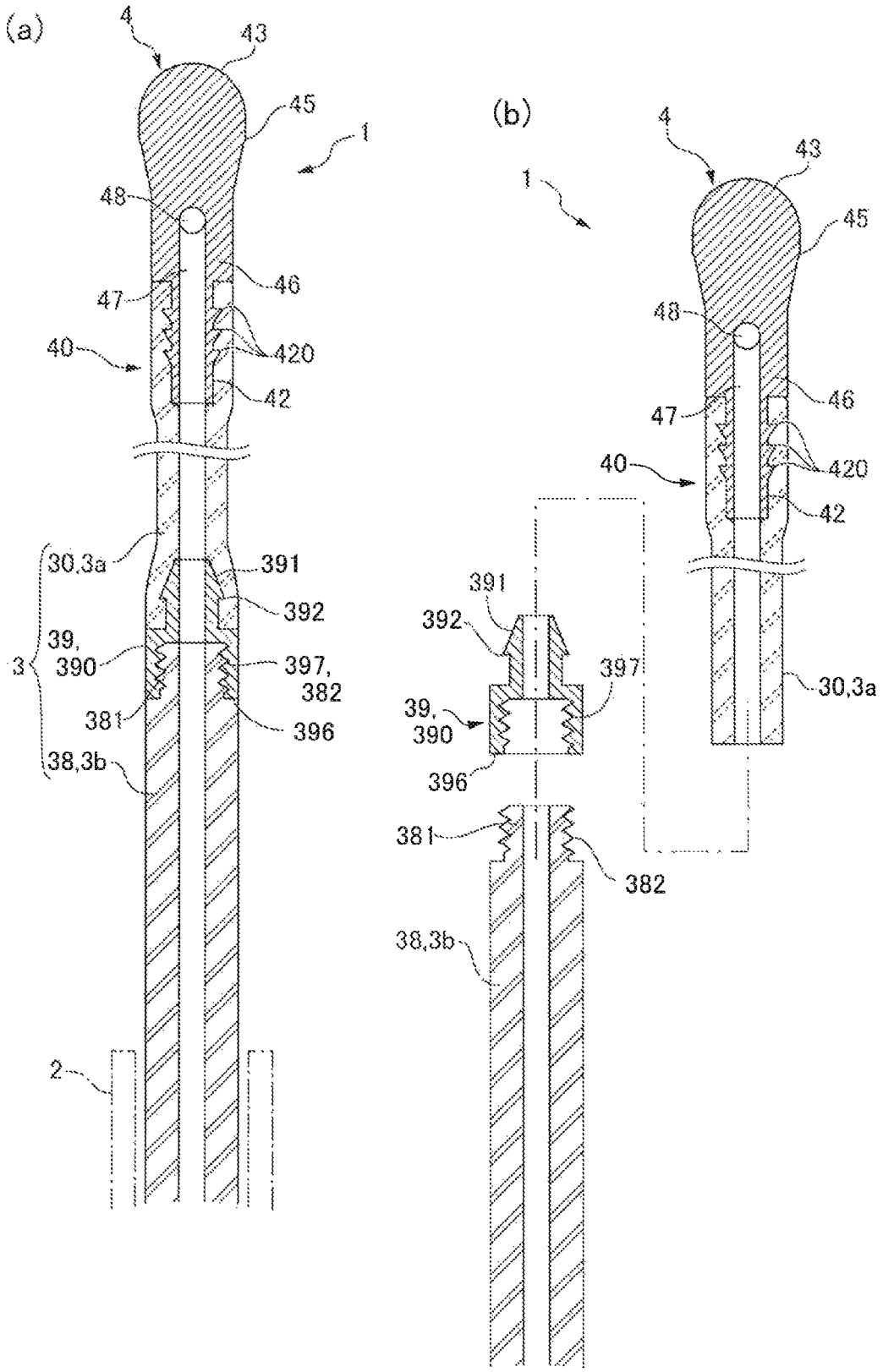
FIG. 10 is diagrams of an injector according to Embodiment 7 of the present invention.

FIG. 10 is diagrams of an injector 1 according to Embodiment 7 of the present invention, and FIGS. 10 (*a*) and (*b*) show a constitution of a frontal side of the injection pipe 3 and a situation where the frontal side of the injection pipe 3 is divided by means of a joint, respectively.

In the injector 1 shown in FIG. 10, the injection pipe 3 comprises a 2nd pipe section 3*b* inserted in the guide pipe 2 on the rear side in a longitudinal direction is constituted by a rigid pipe 38 made of a resin or the like, and the frontal side of the rigid pipe 38 is connected to a flexible tube 30 (1st pipe section 3*a*) via a joint 39. Therefore, the injection pipe 3 can be divided in a longitudinal direction by the joint 39. In the present Embodiment, the length of the tube 30 is from 12 cm to 18 cm.

In the present Embodiment, a cylindrical joint member 390 is used as a joint 39. The frontal side of the joint member 390 in the longitudinal direction constitutes a connection part 391 which connects with the tube 30, and the rear side constitutes a connection part 396 which connects with the rigid pipe 38. The connection part 391 of the present Embodiment is a cylindrical part inserted in the tube 30, and a protruding part 392 which bites into the inner circumferential surface of the tube 30 is formed on the outer peripheral surface of the connection part 391. The protruding part 392 of the present Embodiment has a cross-sectional shape of approximately right-angled triangle with the hypotenuse facing the frontal side. Therefore, even in the case where the protruding part 392 is formed on the outer peripheral surface of the connection part 391, the connection part 391 can be easily inserted into the tube 30, and the protruding part 392 generates a strong resistance force against a force for pulling the connection part 391 out of the tube 30.

The connection part 396 is a cylindrical part, on the inner circumferential surface of which a female screw 397 is formed, and the frontal end of the rigid pipe 38 is a small diameter cylindrical part 381 on which a male screw 382 that mates with the female screw 397 is formed. Since the outer diameter size of the connection part 396 is the same as the outer diameter size of the rigid pipe 38 and the outer diameter size of the tube 30, no steps occur between the joint member 390 and the rigid pipe 38 and between the joint member 390 and the tube 30.

In the injection pipe 3 constituted in such a manner, the injection pipe 3 can be divided in a longitudinal direction by the joint 39 provided at any position in the longitudinal direction. Therefore, in such an injection pipe 3, a portion comprising the joint member 390 and the rigid pipe 38 may be repeatedly used after washing, whereas, a portion comprising the tube 30 and the nozzle 4 may be used only once and then discarded.

The injection pipe 3 is constituted by the flexible tube 30 (1st pipe section 3*a*) and the rigid pipe 38 (2nd pipe section 3*b*) connected to the rear side of the tube 30. Therefore, in manipulating the injection pipe 3, similar effects as Embodiment 1 are exhibited, for example, buckling does not occur at the 2nd pipe section 3*b*. Further, since the 2nd pipe section 3*b* is composed only of the rigid pipe 38, the flexible tube 30 can be shortened, and thus costs for components can be reduced.

The rigid pipe 38 is preferably made of a resin, rather than a metal. Since the rigid pipe 38 made of a resin has a thermal conductivity coefficient lower than the rigid pipe 38 made of a metal, a fertilized ovum(ova) or a sperm(s) passing through the rigid pipe 38 will not be chilled rapidly in carrying out the injection operation in a cold environment. Therefore, loss of the activity of a fertilized ovum(ova) or a sperm(s) due to rapid chilling can be prevented.

As for the joint 39, a constitution in which the tube 30 and the rigid pipe 38 are directly connected to each other (i.e. the joint member 390 is not used) may be adopted. As for the joint member 390, a constitution in which the entire body thereof is arranged inside the tube 30 and the rigid pipe 38 may be adopted. Further, as for the joint 39, a constitution in which the tube 30 and the rigid pipe 38 are directly connected to each other undetachably with an adhesive, or a constitution in which the tube 30 and the rigid pipe 38 are each connected undetachably to the joint member 390 with an adhesive, may be adopted.

[Embodiment 8]

Figure 11:
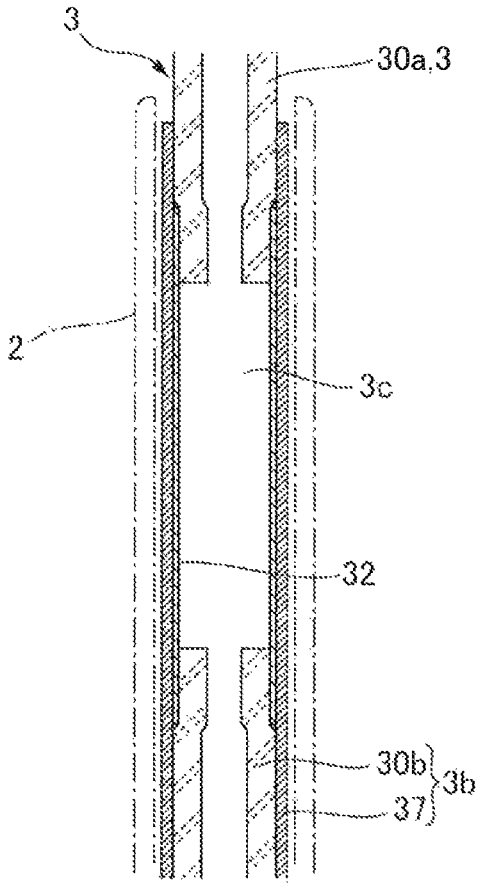
FIG. 11 is a diagram of an injector according to Embodiment 8 of the present invention.

FIG. 11 is a diagram of an injector 1 according to Embodiment 8 of the present invention showing a constitution in the vicinity of a boundary part between the 1st pipe section 3*a* and the 2nd pipe section 3*b* of the injection pipe 3.

As shown in FIG. 11, in the injector 1 of the present Embodiment, the injection pipe 3 comprises a flexible 1st pipe section 3*a* constituting the frontal side of the injection pipe 3, and a 2nd pipe section 3*b* having a rigidity higher than the 1st pipe section 3*a* and constituting the rear side of the injection pipe 3. More specifically, the injection pipe 3 comprises a flexible 1st tube 30*a* which is positioned at the frontal side of the injection pipe 3, a flexible 2nd tube 30*b* which is positioned at the rear side of the 1st tube 30*a*, and a rigid sleeve 37 which is arranged so that the outside of the 2nd tube 30*b* is covered with the sleeve 37. Therefore, the 1st pipe section 3*a* is constituted by the 1st tube 30*a*, and the 2nd pipe section 3*b* is constituted by the 2nd tube 30*b* and the rigid sleeve 37, and the cylindrical connector 6 explained above referring to FIG. 2, etc. is connected to the rear part of the 2nd pipe section 3*b* (the rear part of the rigid sleeve 37). According to the present Embodiment, the 1st tube 30*a* and the 2nd tube 30*b* are made of a flexible resin such as a silicone resin or a poly(vinyl chloride) resin. The rigid sleeve 37 is a rigid pipe made of a metal or a hard resin, and more rigid than the 1st tube 30*a* and the 2nd tube 30*b*.

The 1st tube 30*a* and the 2nd tube 30*b* are apart from each other in an extending direction of the injection pipe 3, and an enlarged diameter space 3*c* having an inner diameter larger than the inner diameter size of the 1st tube 30*a* and the inner diameter size of the 2nd tube 30*b* is formed between the 1st tube 30*a* and the 2nd tube 30*b*. The injection pipe 3 comprises a sleeve 32 made of a resin or a rubber surrounding the enlarged diameter space 3*c*. According to the present Embodiment, as a sleeve 32, one composed of a heat-shrinkable sleeve made of a polyester resin or a poly(vinyl chloride) resin may be used. The sleeve 32 covers the outside of the the end part of the 1st tube 30*a* and the outside of the end part of the 2nd tube 30*b* to connect the end part of the 1st tube 30*a* with the end part of the 2nd tube 30*b*. Further, according to the present Embodiment, the rigid sleeve 37 covers the 2nd tube 30*b* entirely in a longitudinal direction, and covers also the end part of the 1st tube 30*a*, thereby connecting theist tube 30*a* with the 2nd tube 30*b*.

By an injection pipe 3 constituted in such a manner, in a preparation stage a fertilized ovum(ova) or a sperm(s) can be supplied into the injection pipe 3 to retain the fertilized ovum(ova) or the sperm(s) temporarily in the enlarged diameter space 3*c*. Further, according to the present Embodiment, the enlarged diameter space 3*c* is surrounded by the sleeve 32 made of a resin or a rubber, and the sleeve 32 has a function for thermally insulating the enlarged diameter space 3*c* from the outside. Therefore, in wintertime, a fertilized ovum(ova) or a sperm(s) can be supplied into the injection pipe 3 to retain the fertilized ovum(ova) or the sperm(s) temporarily in the enlarged diameter space 3*c* in an indoor preparation stage, and then an injection operation can be conducted outdoors. Since the enlarged diameter space 3*c* is arranged at a position which is positioned in a vagina when the injector 1 is inserted deep into a bovine uterine body in an injection operation, cooling by the outside air can be avoided and therefore loss of the activity of the fertilized ovum(ova) or the sperm(s) can be avoided.

[Embodiment 9]

Figure 12:
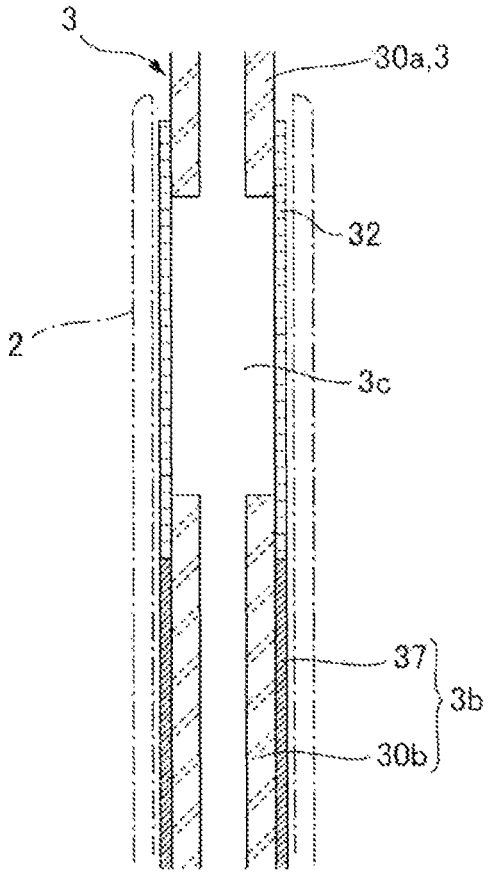
FIG. 12 is a diagram of an injector according to Embodiment 9 of the present invention.

FIG. 12 is a diagram of an injector 1 according to Embodiment 9 of the present invention, showing the constitution in the vicinity of a boundary part between the 1st pipe section 3*a* and the 2nd pipe section 3*b* of the injection pipe 3.

As shown in FIG. 12, in the injector 1 of the present Embodiment, the injection pipe 3 comprises, similarly to Embodiment 1, a flexible 1st pipe section 3*a* constituting the frontal side of the injection pipe 3, and a 2nd pipe section 3*b* having a rigidity higher than the 1st pipe section 3*a* and constituting the rear side of the injection pipe 3. More specifically, the injection pipe 3 comprises, similarly to Embodiment 8, a flexible 1st tube 30*a* which is positioned at the frontal side of the injection pipe 3, a flexible 2nd tube 30*b* which is positioned at the rear side of the 1st tube 30*a*, and a rigid sleeve 37 which covers the outside of the 2nd tube 30*b*. Therefore, the 1st pipe section 3*a* is constituted by the 1st tube 30*a*, and the 2nd pipe section 3*b* is constituted by the 2nd tube 30*b* and the rigid sleeve 37, and the cylindrical connector 6 explained above referring to FIG. 2, etc. is connected to the rear part of the 2nd pipe section 3*b* (the rear part of the rigid sleeve 37). The 1st tube 30*a* and the 2nd tube 30*b* are apart from each other in an extending direction of the injection pipe 3, and an enlarged diameter space 3*c* having an inner diameter larger than the inner diameter size of the 1st tube 30*a* and the inner diameter size of the 2nd tube 30*b* is formed between the 1st tube 30*a* and the 2nd tube 30*b*. Further, the injection pipe 3 comprises a sleeve 32 which is made of a resin or a rubber and surrounds the enlarged diameter space 3*c*. The sleeve 32 covers the outside of the end part of the 1st tube 30*a* and the outside of the end part of the 2nd tube 30*b*. In contrast, the rigid sleeve 37 covers only the 2nd tube 30*b* and does not cover the end part of the 1st tube 30*a*. Therefore, the 1st tube 30*a* and the 2nd tube 30*b* are connected to each other only by the sleeve 32.

By an injection pipe 3 constituted in such a manner, effects similar to Embodiment 8 are exhibited, for example, in a preparation stage a fertilized ovum(ova) or a sperm(s) can be supplied into the injection pipe 3 to retain the fertilized ovum(ova) or the sperm(s) temporarily in the enlarged diameter space 3*c*.

[Embodiment 10]

Figure 13:
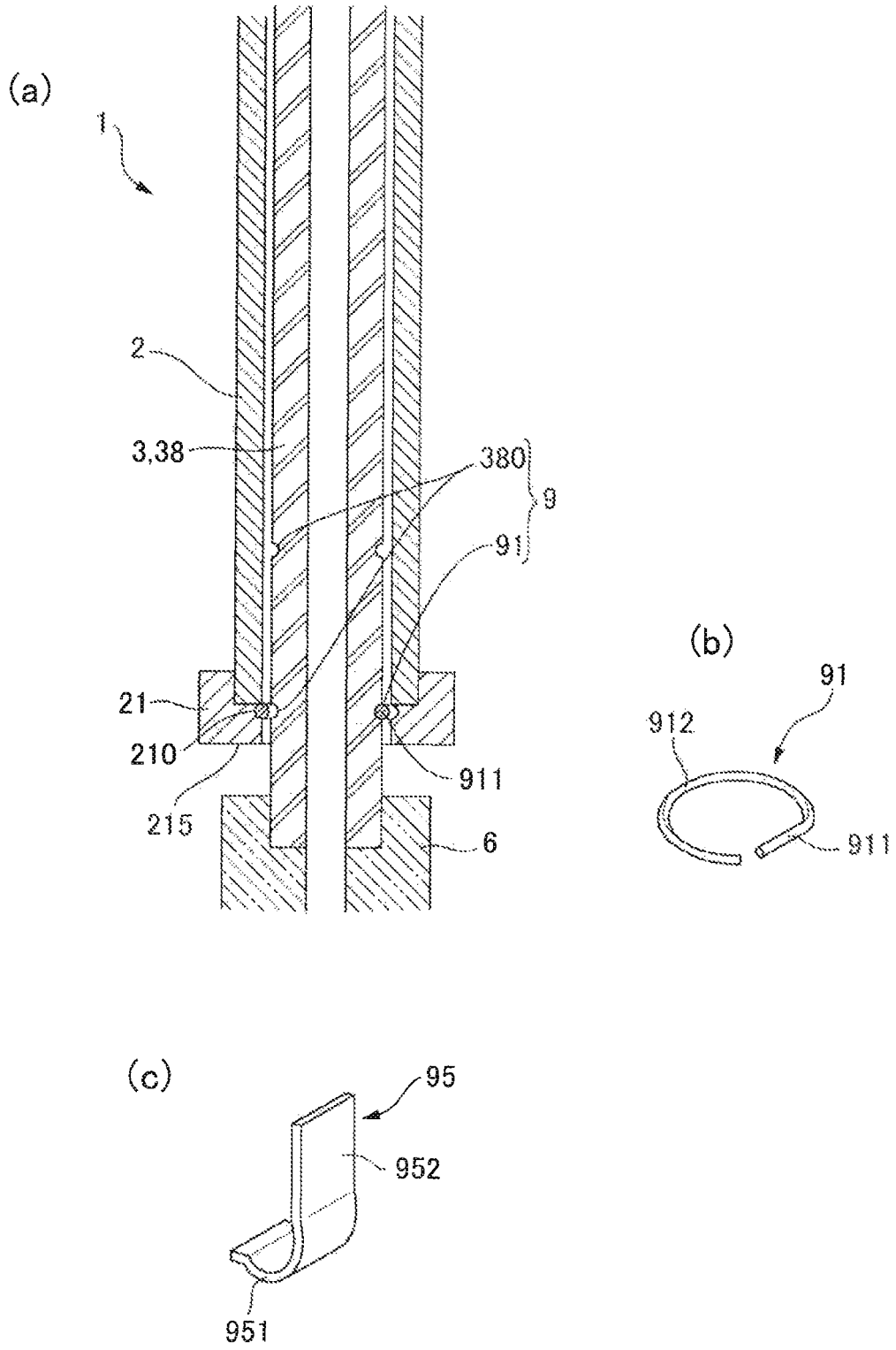
FIG. 13 is diagrams of an injector according to Embodiment 10 of the present invention.

FIG. 13 is a diagram of an injector 1 according to Embodiment 10 of the present invention, and FIGS. 13(*a*), (*b*) and (*c*) show, respectively, a constitution of the rear sides of the guide pipe 2 and the injection pipe 3, a ring-shaped elastic member, and a leaf-spring-like elastic member.

In the injector 1 shown in FIG. 13(*a*), the rear side of the injection pipe 3 (2nd pipe section 3*b*) comprises the rigid pipe 38 made of a resin or the like, and a click mechanism 9 is provided between the injection pipe 3 (rigid pipe 38) and the guide pipe 2. More specifically, circumferential grooves 380 are formed on the outer peripheral surface of the injection pipe 3 at a plurality of positions apart from each other in a longitudinal direction, whereas, an elastic member 91 is held by the guide pipe 2. In this case, the elastic member 91 comprises an engaging part 911 which falls in a predetermined position in a circumferential groove 380 in a circumferential direction. The engaging part 911 is elastically deformable in a radial direction.

In the present Embodiment, a ring shown in FIG. 13(*b*) is used as the elastic member 91, and a part of the circumference of the ring-shaped elastic member 91 extends linearly as an engaging part 911. One of the ends of the engaging part 911 is disconnected from a circular arc part 912, and therefore the engaging part 911 is elastically deformable in a radial direction. Consequently, when the injection pipe 3 is pushed out from the guide pipe 2, how long the injection pipe 3 extrudes can be grasped by a click feeling caused by a load change generated when the engaging part 911 goes in or out from the circumferential groove 380. Also, when the injection pipe 3 is pulled in the guide pipe 2, how long the injection pipe 3 is pulled in can be grasped by a click feeling caused by a load change. In addition, unintended movement of the injection pipe 3 in the guide pipe 2 can be prevented by a load generated by the click mechanism 9.

In attaching the ring-shaped elastic member 91 to the guide pipe 2, a structure in which a flange 21 is attached to the end part of the guide pipe 2 with the circular arc part 912 of the elastic member 91 held in the groove 210 of the flange 21 is adopted in the present Embodiment.

As shown in FIG. 13(*c*), the click mechanism 9 may also be constituted by preparing a leaf-spring-like urging member 95 in which an engaging part 951 is formed by bending a part of a metal plate, and engaging the engaging part 951 with the circumferential groove 380. In the case of such an urging member 95, the urging member 95 can be attached to the guide pipe 2 by bonding a platy part 952 to the end surface 215 of the flange 21. Further, a click mechanism 9 may be provided to an injector 1 in which the rigid sleeve 37 is used as in e.g. Embodiment 1.

[Other Embodiments]

In the above Embodiments, injections of a fertilized ovum(ova) are mainly explained. However, the injector 1 may be used for an injection of a sperm(s) for artificial insemination. In this case, a method in which a straw 7 shown in FIG. 4 which contains a semen(s) is placed in the cylindrical connector 6, as well as a method in which a semen(s) is(are) filled in the fluid supplier 8 as a fluid and then the semen(s) is(are) supplied from the fluid supplier 8 to the nozzle 4 through the injection pipe 3, may be employed.

In the above-described Embodiments, injections of a fertilized ovum(ova) or a sperm(s) to a cow are illustrated. However, the injector 1 may be used for injecting a fertilized ovum(ova) or a sperm(s) to a mammal other than a cow (typically a domestic animal). In that case, the sizes of the respective components (length, diameter, etc.) of the injector may be designed appropriately according to a target mammal.

DESCRIPTION OF SYMBOLS

1 Injector for a fertilized ovum(ova) or a sperm(s)
2 Guide pipe
3 Injection pipe
3*a* 1st pipe section
3*b* 2nd pipe section
3*c* Enlarged diameter space
4 Nozzle
5 Reinforcing pipe for connection
6 Cylindrical connector
7 Straw
8 Fluid supplier
9 Click mechanism
30 Tube
30*a* 1st sleeve
30*b* 2nd sleeve
35 Reinforcing sleeve
36 Flexible sleeve
37 Rigid sleeve
39 Joint
40 Connection part between a tube and a nozzle
41, 42 Connecting cylindrical part
44 Tapered surface
420 Protruding part
422 Recessed part
661 to 663 Step part

The invention claimed is:

1. An injector for injecting a fertilized ovum(ova) or a sperm(s) for artificial insemination into a uterine body, comprising:

a guide pipe for insertion into a uterine body, an injection pipe, which is inserted into the guide pipe, and has a length longer than the guide pipe, and a nozzle connected to a frontal end of the injection pipe, wherein the injection pipe comprises a flexible first pipe section constituting a frontal side of the injection pipe, and a second pipe section being more rigid than the first pipe section and constituting a rear side of the injection pipe, wherein a cylindrical connector is connected with a rear end of the second pipe section, wherein the injection pipe comprises: a flexible tube having a length longer than the guide pipe, and being inserted into the guide pipe; and a rigid sleeve which is arranged so that an outside of a rear part of the tube is covered with the rigid sleeve, leaving a frontal part of the tube in an exposed state, and whose rigidity is higher than the tube, wherein the first pipe section is constituted by a portion of the tube protruding from the rigid sleeve at a frontal side, and the second pipe section is constituted by the rigid sleeve and a portion of the tube positioned inside the rigid sleeve, wherein the nozzle comprises a stopping part having an outer diameter size larger than an inner diameter size of the guide pipe, and a connecting cylindrical part connected to the frontal end of the injection pipe on a rear side from the stopping part, wherein the connecting cylindrical part is inserted into the injection pipe at a connection part between the injection pipe and the connecting cylindrical part, and wherein at least either one of a protruding part(s) that bite(s) into an inner surface of the injection pipe and a recessed part(s) that is(are) bitten into by the injection pipe is formed on an outer surface of the connecting cylindrical part.

2. The injector according to claim 1, wherein the cylindrical connector is an integrally molded item which is made of a resin or a rubber and comprises a plurality of step parts formed on an inner circumferential surface thereof, said step parts each enlarging an inner diameter size at both sides of a central portion in an axis line direction.

3. The injector according to claim 1, wherein an outer peripheral surface of the cylindrical connector has a shape for preventing rotation of the cylindrical connector around an axis line.

4. The injector according to claim 1, wherein at least a frontal end of the rigid sleeve is fixed to the tube by adhesion.

5. The injector according to claim 1, wherein the stopping part is formed by a portion of the nozzle, the outer diameter size of which increases continuously from a rear side toward a frontal side, and a portion ranging from a connection part between the injection pipe and the connecting cylindrical part to the stopping part extends without any step part having an outer diameter size larger than the outer diameter size of the first pipe section and facing toward the injection pipe.

6. The injector according to claim 1, comprising a click mechanism for changing a load when the injection pipe is advanced or retreated in the guide pipe, said click mechanism being provided between the injection pipe and the guide pipe.

7. The injector according to claim 1, wherein a frontal end of the rigid sleeve is not exposed outside of the guide pipe in a state where a frontal side of the injection pipe is pushed out from the guide pipe.

8. The injector according to claim 1, wherein the injection pipe does not have a reinforcing layer with which a boundary part between the first pipe section and the second pipe section is covered.

9. The injector according to claim 1, wherein the protruding part does not have a spiral shape.

* * * * *